US007896088B2

(12) United States Patent
Guerrero et al.

(10) Patent No.: US 7,896,088 B2
(45) Date of Patent: Mar. 1, 2011

(54) WELLSITE SYSTEMS UTILIZING DEPLOYABLE STRUCTURE

(75) Inventors: Julio C. Guerrero, Cambridge, MA (US); Hitoshi Tashiro, Kamakura (JP); Bartley Patton, Sugar Land, TX (US); Hubertus V. Thomeer, Houston, TX (US); Robin Mallalieu, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 398 days.

(21) Appl. No.: 12/034,191

(22) Filed: Feb. 20, 2008

(65) Prior Publication Data

US 2009/0159295 A1 Jun. 25, 2009

Related U.S. Application Data

(63) Continuation-in-part of application No. 11/962,256, filed on Dec. 21, 2007.

(51) Int. Cl.
*E21B 23/00* (2006.01)

(52) U.S. Cl. ..... 166/382; 166/206; 166/381

(58) Field of Classification Search ..... 166/381, 166/382, 206

See application file for complete search history.

(56) References Cited

U.S. PATENT DOCUMENTS

| | | | | |
|---|---|---|---|---|
| 3,066,637 | A | 9/1961 | Akutowicz | |
| 3,460,625 | A * | 8/1969 | Ellis et al. | 166/285 |
| 3,575,238 | A * | 4/1971 | Shillander | 166/187 |
| 3,606,924 | A * | 9/1971 | Malone | 166/187 |
| 3,623,566 | A | 11/1971 | Orloff | |
| 3,982,248 | A | 9/1976 | Archer | |
| 4,105,215 | A | 8/1978 | Rathburn | |
| 4,345,658 | A | 8/1982 | Danel et al. | |
| 4,424,861 | A | 1/1984 | Carter, Jr. et al. | |
| 4,942,700 | A | 7/1990 | Hoberman | |
| 5,005,658 | A | 4/1991 | Bares et al. | |
| 5,024,031 | A | 6/1991 | Hoberman | |

(Continued)

FOREIGN PATENT DOCUMENTS

EP 0010601 B1 5/1980

(Continued)

OTHER PUBLICATIONS

Abou, B., D. Bonn, and J. Meunier, "Nonlinear Rheology of Laponite Suspensions Under an External Drive." J. Rheol. 47, 2003, pp. 979-988.

(Continued)

*Primary Examiner* — Hoang Dang
(74) *Attorney, Agent, or Firm* — Michael Dae; Michael Flynn; David Cate

(57) ABSTRACT

An apparatus for deploying an instrument usable with a well comprises at least one reversibly expandable structure, at least one actuator operable to change a perimeter dimension of the at least one reversibly expandable structure, at least one instrument disposed interior of the at least one reversibly expandable structure, and having an axial dimension, and tractoring fluid disposed between the at least one reversibly expandable structure and the at least one instrument. The apparatus is operable to perform at least one of exerting thrust to convey the at least one instrument with respect to at least one adjacent surface, creating compensating pressure between the at least one instrument and the at least one adjacent surface, and sealing between the at least one instrument and the at least one adjacent surface.

27 Claims, 24 Drawing Sheets

U.S. PATENT DOCUMENTS

| | | | | |
|---|---|---|---|---|
| 5,448,567 | A | 9/1995 | Wilson | |
| 5,448,867 | A | 9/1995 | Wilson | |
| 5,788,002 | A | 8/1998 | Richter | |
| 6,082,056 | A | 7/2000 | Hoberman | |
| 6,248,096 | B1 | 6/2001 | Dwork et al. | |
| 6,299,173 | B1 | 10/2001 | Lai | |
| 6,379,071 | B1 | 4/2002 | Sorvino | |
| 6,512,345 | B2 | 1/2003 | Borenstein et al. | |
| 6,513,601 | B1 | 2/2003 | Gunnarsson et al. | |
| 6,601,652 | B1 * | 8/2003 | Moore et al. | 166/381 |
| 6,910,533 | B2 | 6/2005 | Guerrero | |
| 7,044,245 | B2 | 5/2006 | Anhalt et al. | |
| 7,059,410 | B2 | 6/2006 | Bousche et al. | |
| 7,156,192 | B2 | 1/2007 | Guerrero | |
| 7,235,046 | B2 | 6/2007 | Anhalt et al. | |
| 7,334,642 | B2 | 2/2008 | Doering et al. | |
| 7,401,665 | B2 | 7/2008 | Guerrero et al. | |
| 2004/0097876 | A1 | 5/2004 | Shkolnik | |
| 2005/0016302 | A1 | 1/2005 | Simpson | |
| 2005/0090893 | A1 | 4/2005 | Kavteladze et al. | |

FOREIGN PATENT DOCUMENTS

| | | | |
|---|---|---|---|
| EP | 0101805 | B1 | 12/1986 |
| EP | 0106016 | B1 | 12/1986 |
| EP | 0118619 | B1 | 9/1988 |
| EP | 0443408 | B1 | 2/1994 |
| EP | 0455850 | B1 | 5/1995 |
| EP | 1005884 | A2 | 6/2000 |
| EP | 1072295 | A2 | 1/2001 |
| EP | 1073825 | B1 | 2/2001 |
| EP | 1219754 | A1 | 7/2002 |
| EP | 1350917 | | 10/2003 |
| GB | 2368082 | A | 4/2002 |
| GB | 2371066 | A | 7/2002 |
| GB | 2397084 | A | 7/2004 |
| WO | 9727369 | | 7/1997 |
| WO | 02063111 | A1 | 8/2002 |
| WO | 03054318 | A2 | 7/2003 |
| WO | 2004000137 | A2 | 12/2003 |
| WO | 2005008023 | A1 | 1/2005 |
| WO | 2005031115 | A1 | 4/2005 |

OTHER PUBLICATIONS

"The Apple Snail Webstie.", Jul. 27, 2006, http://www.applesnail.net/content/species/asolene_asolene_spixi.htm.

Ashmore, J., C. Del Pino, and T. Mullin, "Cavitation in a Lubrication Flow Between a Moving Sphere and a Boundary." Physical Review Letters 94, 2005, pp. 124501-1 to 124501-4.

Balmforth, N.J., and R.V. Craster, "A Consistent Thin-Layer Theory for Bingham Plastics." J. Non-Newtonian Fluid Mech. 84, 1999, pp. 65-81.

Cook, G. "MIT Scientists Copy the Snail's Pace." The Boston Globe, Jul. 3, 2003: A1.

Denny, M. "The Role of Gastropod Pedal Mucus in Locomotion" Nature 285, May 1980, pp. 160-161.

Denny, M.W. A Quantitative Model for the Adhesive Locomotion of the Terrestrial Slug, Ariolimax Columbianus, J. Exp. Biol. 91, 1981, pp. 195-217.

Hancock, G.J. "The Self-Propulsion of Microscopic Organisms Through Liquids" Proceedings of the Royal Society of London, Series A., Mathematical and Physical Sciences 217, 1953, pp. 96-121.

Itoh, et al. "Film Structured Soft Actuator for Biomimetics of Snail's Gastropod Locomotion" 6th International Conference Control, Automation, Robotics and Vision ICARCV'2000, 2000.

Lissman, H.W. "The Mechanism of Locomotion in Gastropod Molluscs" The Journal of Experimental Biology 21, 1945, pp. 58-69.

Lissmann, H.W. "The Mechanism of Locomotion in Gastropod Molluscs" The Journal of Experimental Biology 22, 1946, pp. 37-50.

Mahadevan et al. "Biomimetic Ratcheting Motion of a Soft, Slender, Sessile Gel" PNAS 101 (1), 2004, pp. 23-26.

Moffett, S. "Locomotion in the Primitive Pulmonate Snail Melampus Bidentatus: Foot Structure and Function" The Biological Bulletin 157, Oct. 1979, pp. 306-319.

Reynolds, O. "On the Theory of Lubrication and its Application to Mr. Beauchamp Tower's Experiments, Including and Experimental Determination of the Viscosity of Olive Oil" Philos. Trans. R. Soc. London, Ser. A 177, 1886, pp. 157-235.

Skotheim, J.M. et al. "Soft Lubrication" Physical Review Letters vol. 92, No. 24, Jun. 2004, pp. 245509-1 to 245509-4.

Taylor, G. "Analysis of the Swimming of Miscroscopic Organisms" Proceedings of the Royal Society of London, Series A, Mathematical and Physical Sciences 209, 1951, pp. 447-461.

Vles, F. "Zoologie.—Sur les ondes pedieuses des Mollusques reptateurs" C.R. Acad. Sci., Paris 145, 1907, pp. 276-278.

Willenbacher, N. "Unusual Thixotropic Properties of Aqueous Dispersions of Laponite RD" Journal of Colloid and Interface Science 182, 1996, pp. 501-510.

* cited by examiner

WELLSITE SYSTEMS UTILIZING DEPLOYABLE STRUCTURE

CROSS REFERENCE TO RELATED APPLICATIONS

This application is a continuation-in-part of commonly assigned and co-pending application U.S. Ser. No. 11/962,256, filed Dec. 21, 2007, the entire disclosure of which is hereby incorporated by reference.

BACKGROUND OF THE INVENTION

The present invention relates generally to systems that deploy, convey, or otherwise interact with instruments in oilfield operations including, but not limited to, well services, completions, wireline, marine and land seismic jobs, and sub sea oil exploration and the like. The present invention also relates generally to the field of reversibly expandable loop assemblies and actuators for transforming reversibly expandable loop assemblies between expanded and collapsed states.

Embodiments of the present invention also relate generally to a class self-supporting structures configured to expand or collapse, while maintaining their overall shape as they expand or collapse in a synchronized manner. Such structures have been used for diverse applications including architectural uses, public exhibits, and unique folding toys. A basic building block of such structures is a "loop-assembly" that consists of three or more scissor units (described in U.S. Pat. Nos. 4,942,700 and 5,024,031) or polygon-link pairs (described in U.S. Pat. Nos. 6,082,056 and 6,219,974), each consisting of a pair of links that are pinned together at pivots lying near the middle of each link. Such a loop assembly includes a ring of interconnected links that can freely fold and unfold. Exemplary structures and methods for constructing such reversibly expandable truss-structures in a wide variety of shapes are described in the above referenced patents. Structures that transform in size or shape have numerous uses. If one desires to have a portable shelter of some kind, it should package down to a compact bundle (tents being a prime example).

It is desirable to provide a system and apparatus for deploying tools into a wellbore and/or in wellsite equipment.

SUMMARY OF THE INVENTION

According to an embodiment of the present invention, an apparatus and a method for deploying an instrument usable with a well comprises at least one reversibly expandable structure, at least one actuator operable to change a perimeter dimension of the at least one reversibly expandable structure, at least one instrument disposed interior of the at least one reversibly expandable structure, and having an axial dimension, and tractoring fluid disposed between the at least one reversibly expandable structure and the at least one instrument. The apparatus is operable to perform an operation on the instrument with respect to at least one adjacent surface. The operation is preferably at least one of exerting thrust to convey the at least one instrument with respect to the at least one adjacent surface, creating compensating pressure between the at least one instrument and the at least one adjacent surface, and sealing between the at least one instrument and the at least one adjacent surface.

Alternatively, the perimeter dimension of the at least one reversibly expandable structure is variable, lockable, and adjustable. Alternatively, the at least one reversibly expandable structure has a predetermined maximum and minimum perimeter dimension defined by an expansion ratio. The at least one actuator may be operable to move the at least one reversibly expandable structure between the maximum and minimum perimeter dimensions. Alternatively, the at least one actuator comprises a one of a linear actuator, a rotary actuator, a rotatable disk actuator, a lever actuator, and a Peaucellier-Lipkin type actuatable linkage.

Alternatively, the apparatus or method further comprises at least one compliant mechanism attached to an interior perimeter of the at least one reversibly expandable structure. The at least one compliant mechanism may be disposed between the at least one reversibly expandable structure and the at least one instrument. The compliant mechanism may comprise at least one compliant ring. Alternatively, the at least one reversibly expandable structure is operable to engage with instruments and adjacent surfaces having a range of dimensions. Alternatively, the at least one adjacent surface is a wellsite equipment surface and the instrument may comprise a one of an injector, a blow out preventer, a slip ram, a shear ram and a stripper. Alternatively, the at least one adjacent surface is a surface in a wellbore and the instrument may comprises a one of patch, a plug, an actuator, a tractor, a logging tool, and a sliding sleeve.

Alternatively, the apparatus produces thrust in the instrument by propagating a one of retrograde film wave motion and direct wave film motion in the tractoring fluid. Alternatively, the apparatus produces thrust by inch-worm motion. Alternatively, the apparatus further comprises sealing material disposed between the outer surface of the instrument and the inner surface of a one of the at least one reversibly expandable structure. Alternatively, the at least one reversibly expandable structure comprises at least a pair of reversibly expandable structures connected in series along an axial dimension of the at least one instrument. Each of the reversibly expandable structures may perform one of exerting thrust to convey the at least one instrument with respect to at least one adjacent surface, creating pressure between the at least one instrument and at least one adjacent surface, and sealing between the at least one instrument and at least one adjacent surface.

In another embodiment, the present invention provides an apparatus for wellsite surface equipment disposed adjacent a wellbore comprising at least one reversibly expandable structure disposed adjacent at least one wellsite surface, at least one actuator operable to move the at least one reversibly expandable structure between an expanded state defining a first diameter and a collapsed state defining a second diameter, the first diameter greater than the second diameter. The apparatus is operable to at least seal the at least one wellsite surface against wellbore pressure. Alternatively, the apparatus seals the at least one wellsite surface by closing off the wellbore in its collapsed state. Alternatively, the at least one actuator comprises a one of a linear actuator, a rotary actuator, a rotatable disk actuator, a lever actuator, and a Peaucellier-Lipkin type actuatable linkage. Alternatively, the at least one reversibly expandable structure is lockable at predetermined positions between the expanded state and the collapsed state. Alternatively, the apparatus is operable to convey the apparatus with respect to the at least one wellsite surface by inch-worm motion Alternatively, the apparatus further comprises at least one tubular adapted to be disposed in the wellbore via the surface equipment. The apparatus is preferably operable to seal the tubular and the wellsite equipment against wellbore pressure. The apparatus may comprise a one of an injector, a blow out preventer, a slip ram, a shear ram and a stripper. The at least one actuator may comprise a one of a linear actuator, a rotary actuator, a rotatable disk actuator, a lever actuator, and a Peaucellier-Lipkin type actuatable linkage. The at least one reversibly expandable structure is preferably lockable at predetermined positions between the expanded state and the collapsed state.

In another embodiment, the present invention provides a method for sealing wellsite surface equipment with respect to a wellbore, comprising the steps of providing an apparatus comprising at least one reversibly expandable structure disposed adjacent at least one wellsite surface, at least one actuator operable to move the at least one reversibly expandable structure between an expanded state defining a first diameter and a collapsed state defining a second diameter, the first diameter greater than the second diameter, operating the actuator to move the at least one reversibly expandable structure from the expanded state to the collapsed state to at least seal the at least one wellsite surface against wellbore pressure.

Alternatively, the operating step comprises the apparatus sealing the at least one wellsite surface by closing off the wellbore in its collapsed state. Alternatively, the at least one actuator comprises a one of a linear actuator, a rotary actuator, a rotatable disk actuator, a lever actuator, and a Peaucellier-Lipkin type actuatable linkage. Alternatively, the at least one reversibly expandable structure is lockable at predetermined positions between the expanded state and the collapsed state. Alternatively, the operating step further comprises conveying the apparatus with respect to the at least one wellsite surface Alternatively, the method further comprises providing at least one tubular adapted to be disposed in the wellbore via the surface equipment. The operating step may comprise sealing the tubular and the wellsite equipment against wellbore pressure. Alternatively, the apparatus comprises a one of an injector, a blow out preventer, a slip ram, a shear ram and a stripper. Alternatively, the at least one actuator comprises a one of a linear actuator, a rotary actuator, a rotatable disk actuator, a lever actuator, and a Peaucellier-Lipkin type actuatable linkage. Alternatively, the at least one reversibly expandable structure is lockable at predetermined positions between the expanded state and the collapsed state.

The apparatus, method, or system in accordance with embodiments of the present invention advantageously combines a mechanical system (a reversibly expandable or deployable structure) that utilizes thin film fluid mechanics in non newtonian fluids to convey instruments, such as in a wellbore or the like.

Embodiments of the apparatus and system of the present invention are operable to exert thrust in order to convey instruments in their longitudinal axis, seal the instrument such as during their conveyance, and pressure compensate during their conveyance. Similarly, an embodiment of the system may comprise a module or assembly that includes all these capabilities or can have several modules addressing each one of them separately.

BRIEF DESCRIPTION OF THE DRAWINGS

These and other features and advantages of the present invention will be better understood by reference to the following detailed description when considered in conjunction with the accompanying drawings wherein.

DETAILED DESCRIPTION OF THE INVENTION

Figure 1A:
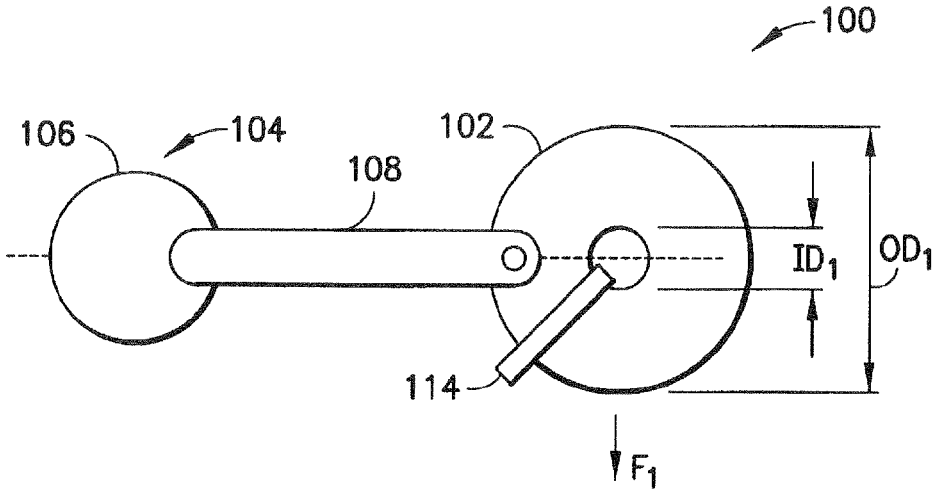
FIG. 1A and FIG. 1B respectively illustrate a schematic diagram of an actuatable deployable structure according to the present invention in collapsed and expanded states.

A schematic diagram of an actuatable deployable structure system 100 is shown in FIG. 1A. The actuatable deployable structure system 100 includes a reversibly expandable structure 102 coupled to an actuator 104. The reversibly expandable structure is transformable between expanded and collapsed states. In some embodiments, the reversibly expandable structure is an annular disk 102, as shown. The actuator 104 provides an actuation force for adjusting the reversibly expandable structure 102 between the collapsed and expanded states. The actuator 104 can include a force generator, or motor 106 providing the actuation force and a linkage 108 coupled between the motor 106 and the reversibly-expandable structure 102. The linkage 108 conveys the actuation force from the motor 106 to the reversibly expandable structure 102. In some embodiments, the motor 106 is coupled directly to the reversibly-expandable structure 102. Kinematics details of exemplary reversibly expandable structures, also referred to as deployable structures is provided in World Intellectual Property Organization Publication No. WO1997027369.

Figure 1B:
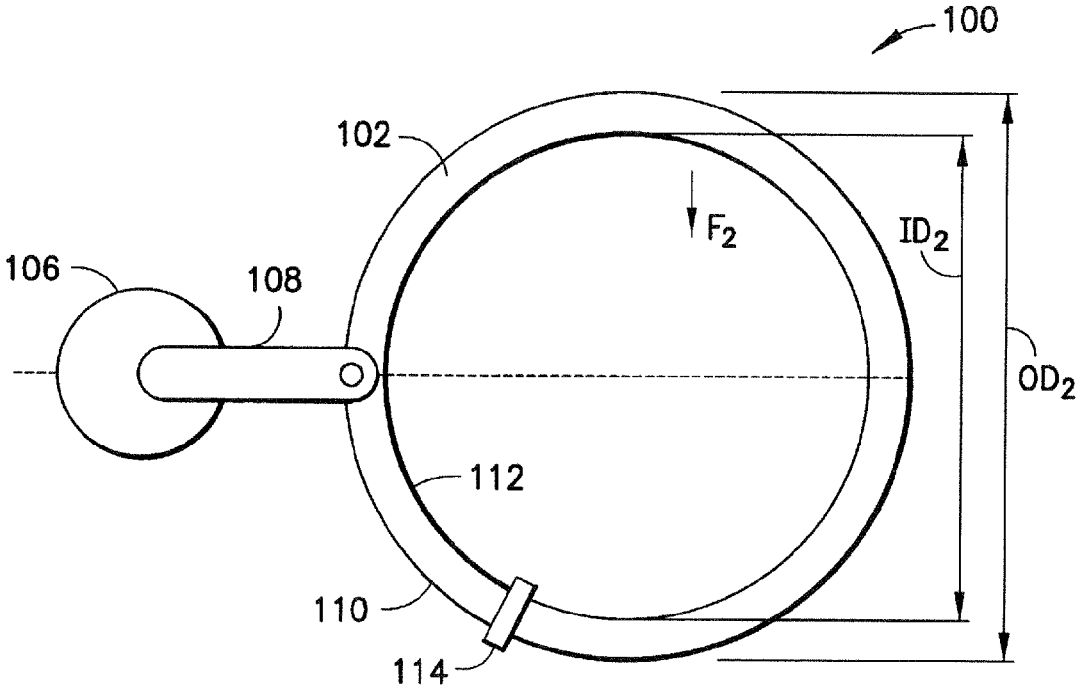

In the exemplary embodiment, the reversibly expandable structure 102 in its collapsed state is circular having an outside diameter OD1. In some embodiments, the deployable structure system is annular, also having an inside diameter ID1. In operation, the motor 106 generates an expansion actuation force coupled to the reversibly expandable structure 102 through the linkage 108 causing the reversibly expandable structure 102 in a collapsed state to expand. Upon application of a sufficient expansion actuation force, the reversibly expandable structure 102 is transformed, or expanded, to a fully expanded state as shown in FIG. 1B. In the expanded state, the reversibly expandable structure 102 can also be an annular structure having a fully expanded outside diameter OD2 that is greater than the outside diameter of the collapsed state (i.e., OD2>OD1). In the exemplary embodiment, the fully expanded inside diameter ID2 is also greater than the inside diameter of the collapsed state (ID2>ID1).

In some embodiments, the motor 106 remains coupled to the reversibly expandable structure 102 in the expanded state, producing a contracting activating force that reconfigures the reversibly expandable structure 102 from an expanded state (FIG. 1B) to a collapsed state (FIG. 1A). Transformation from a collapsed state to an expanded state can be referred to as an expansion stroke; whereas, transition from an expanded state to a collapsed state can be referred to as a contraction stroke. The actuatable deployable structure system 100 produces an outward directed force F1 during the expansion stroke, and an inward directed force F2 during the contraction stroke of the reversibly expandable device 102. The outward directed force F1 can perform work by its application over a distance traveled by a point on the reversibly expandable structure 102 during transformation from a collapsed state to an expanded state. For example, worked performed in an expansion stroke can be determined as the force F1 multiplied by the distance the external perimeter 110 travels during the expansion stroke: 0.5*(OD2-OD1). Likewise, the inward directed force F2 can also perform work by its application along the distance traveled by a point on the reversibly expandable structure 102, such as the distance internal perimeter 112 travels during a contraction stroke: 0.5*(ID2-ID1). In the exemplary annular embodiment, the forces F1, F2 are radially directed forces.

In some embodiments, the system includes a lock 114 configured to hold the reversibly expandable structure 102 in a fixed state of transformation between expanded and collapsed states. In a locked state, the reversibly expandable structure 102 can provide a loading force F1, F2 opposing loading of the device. For example, a lock can be engaged in at least one of the collapsed or expanded states to retain the reversibly expandable structure 102 in the locked configuration in the presence of external forces acting upon the structure. Keys 114 can include pins insertable into a mechanical linkage of the reversibly expandable structure 102 to prohibit expansion or contraction. In some embodiments, the motor 106 can function as a lock by providing an opposing force to prevent further expansion or collapse of the reversibly expandable structure 102 in a locked state.

In some embodiments, one of the inside or outside diameters remains substantially constant during transition from collapsed to expanded states, while the other one of the inside or outside diameters varies as just described. An exemplary structure in which the outside diameter remains substantially constant, while the inside diameter varies is described in U.S. Pat. No. 5,024,031.

The reversibly expandable device 102 is substantially planar, such that expansion and collapse occur parallel to a plane. Examples of such planar devices included the disk structures described herein. In some embodiments, the reversibly expandable device can be a three dimensional structure, such that expansion and collapse occur in three dimensions. Examples of some three dimensional structures include spherical devices.

Figure 2A:
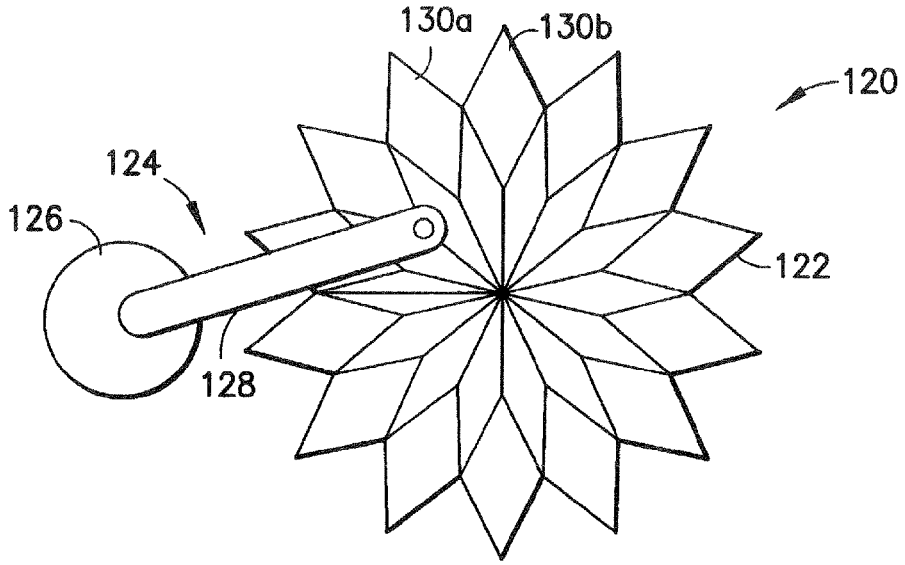
FIG. 2A and FIG. 2B respectively illustrate a planar view of one embodiment of a actuatable deployable structure system including a closed mechanical linkage of angulated elements according to the present invention in collapsed and expanded states.

FIG. 2A illustrates a planar view of an exemplary embodiment of an actuatable deployable structure system 120 including a reversibly expandable structure 122 formed from an enclosed mechanical linkage. The system 120 also includes an actuator 124 having a force generator, or motor 126 and a linkage 128 coupled between the motor 126 and the reversibly expandable structure 122. The enclosed mechanical linkage 122 in a collapsed state, as shown, covers a circular area without a central aperture. The enclosed mechanical linkage 122 includes a series of basic interlinked modules 130*a*, 130*b* (generally 130) arranged around a central point. In this embodiment, the deployable structure's kinematics modules have three linkages each.

Figure 2B:
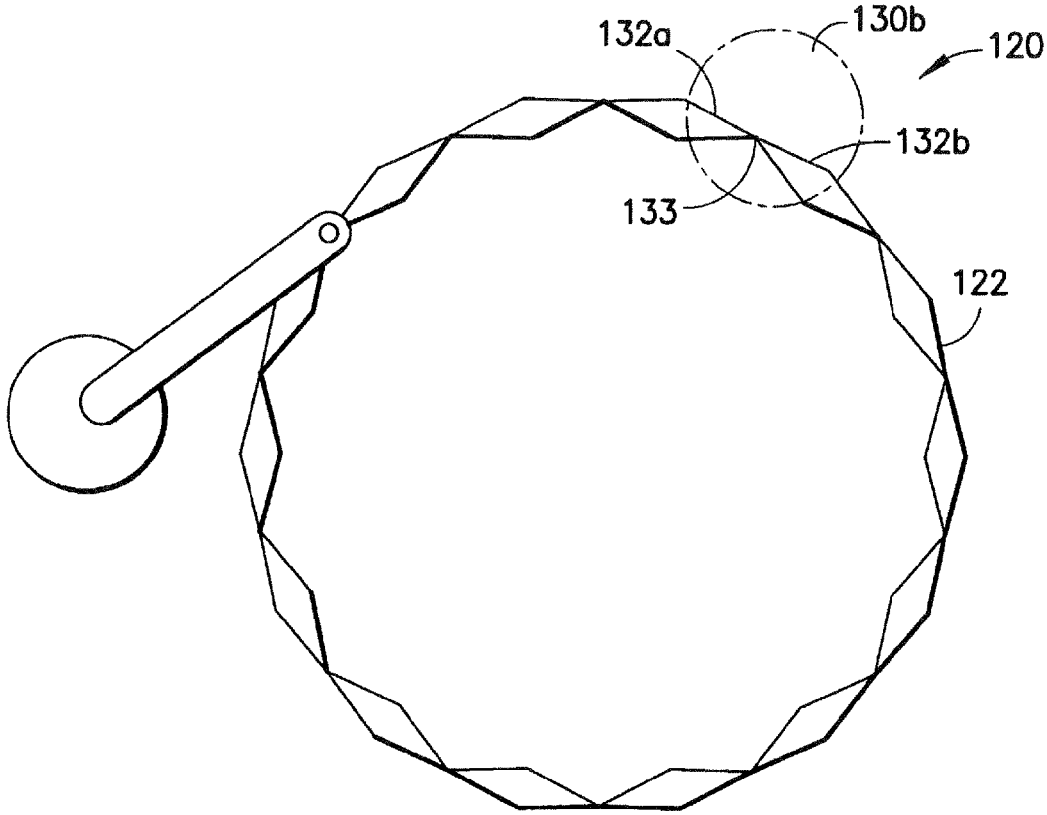

Referring now to FIG. 2B illustrating an expanded state of the actuatable deployable structure system 120, each of the basic interlinked modules 130, sometimes referred to as petals, includes a pair of pivotally interconnected members 132*a*, 132*b* (generally 132) that when actuated exhibit a scissor action about a central pivot 133. The ends of each interconnected member 132 are pivotally connected to respective ends of members of an adjacent element. By providing angles or kinks in the individual interconnected members 132, a closed loop is formed as shown. The shape of the closed loop can be circular, elliptical, polygonal, and in general any arbitrary shape. Polygonal shaped closed loop structures are described in U.S. Pat. No. 5,024,031.

Figure 3B:
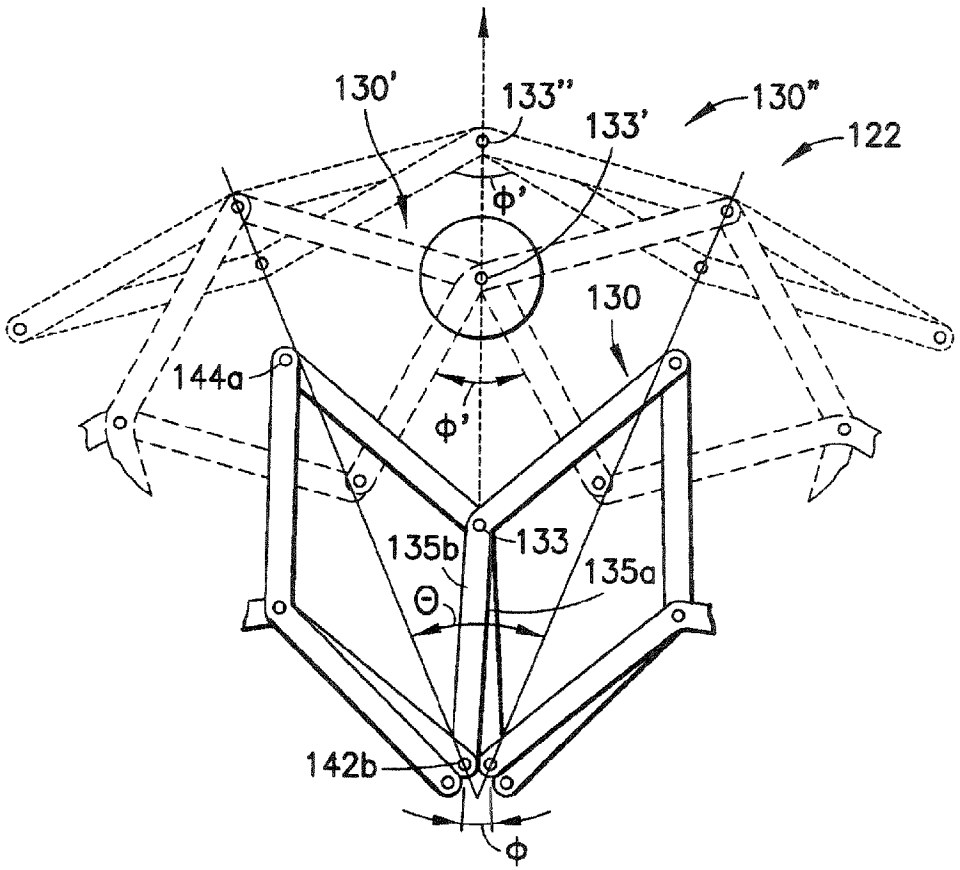
FIG. 3B illustrates a planar view of a segment of the basic module of FIG. 2A and FIG. 2B interlinked to similar basic modules forming a portion of a deployable structure, in collapsed, partially expanded, and expanded configurations according to the present invention.
Figure 3A:
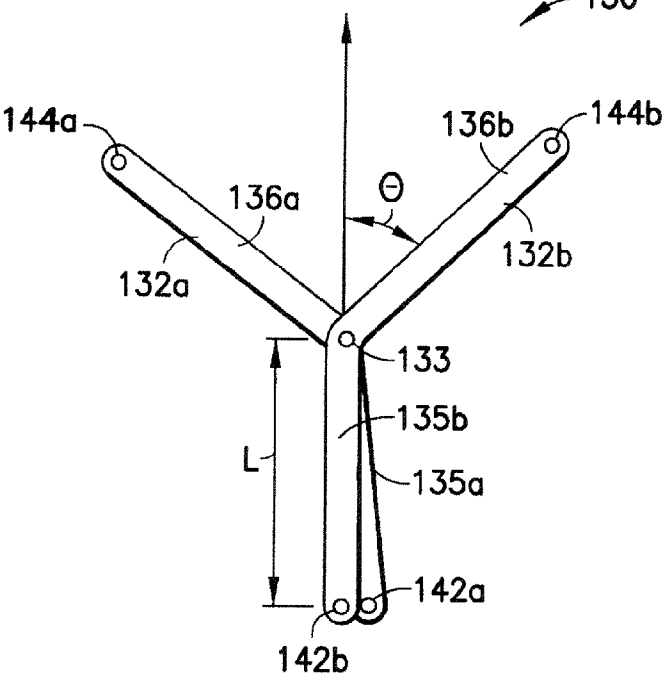
FIG. 3A illustrates a planar view of one embodiment of a basic module of the actuatable deployable structure system of FIG. 2A and FIG. 2B.

An exemplary basic module 130 of the reversibly expandable structure 122 is illustrated in more detail in FIG. 3A. The basic module 130 includes a pair of substantially rigid members or struts 132*a*, 132*b* pivotally joined around a central pivot 133. A left-hand strut 132*a* is angled, having a first linear portion 135*a* extending from the central pivot 133 to an inner right-hand pivot 142*a*. A second linear portion 136*a* of the left-hand strut 132*a* extends from the central pivot 133 to an outer left-hand pivot 144*a*. The second linear portion 136*a* is angled with respect to the first 135*a*, aligned at an angle θ from the first linear portion. This angle θ is referred to as a strut angle. A right-hand strut 132*b* can be substantially identical to the left-hand strut 132*a*, being aligned as a mirror image to the left-hand strut 132*a* with respect to a radius from the center of the reversibly expandable structure. Thus, the right-hand strut 132*b* is angled, having a first linear portion 135*b* extending from the central pivot 133 to an inner left-hand pivot 142*b*. A second linear portion 136*b* of the right-hand strut 132*b* extends from the central pivot 133 to an outer right-hand pivot 144*b*. The second linear portion 136*b* is angled with respect to the first 135*b*, also aligned at an angle θ from the first linear portion. In some embodiments, the left-hand strut 132*a* is different from the right-hand strut 132*b*.

A more detailed illustration of the basic module 130 integrated within the reversibly expandable structure 122 is illustrated in FIG. 3B. The basic module 130 is shown with its central pivot 133 aligned along a radius of the reversibly expandable structure 122. The outer left-hand pivot 144*a* is joined to an outer right-hand pivot of an adjacent basic module. The inner left-hand pivot 142*b* is joined to the inner right-hand pivot of an adjacent basic module. Similarly, the outer right-hand pivot 144*b* and the inner right-hand pivot 142*a* of the basic module 130 are joined to another adjacent basic module on an opposite side. An angle ϕ is formed between the first linear portions 135*a* of the left-hand strut 132*a* and the first linear portion 135*b* of the right-hand strut 132*b*. In a collapsed state, the angle ϕ is minimum. In the exemplary embodiment, the minimum angle ϕ approaches zero. However, due to a finite width of each strut 132*a*, 132*b* the minimum angle is slightly greater than zero.

As the reversibly expandable structure 122 transitions from a collapsed state to an expanded state, the first and second angle members 132*a*, 132*b* pivot with respect to each other such that the angle ϕ formed between the first angled portion of each of the angled members 132*a*, 132*b* increases. The basic module 130' is illustrated in phantom in a partially expanded state with an angle $\phi'>\phi$. The basic module 130" is illustrated in phantom again in a fully expanded state with an angle $\phi''>\phi'>\phi$. The central pivot 133, 133', 133" of the basic module 130, 130', 130" travels along a common radial line throughout transformation from collapsed to expanded states.

Throughout this transition, the basic module 130 remains pivotally interconnected to adjacent basic modules on either side through its left-hand and right-hand pivots 142*b*, 144*a*, 142*a*, 144*b*. The inner and outer pivots 142*b*, 144*a*, 142*a*, 144*b* pivot with respect to each of the adjacent basic modules, such that the inner and outer pivots 142*b*, 144*a* and 142*a*, 144*b* are drawn toward each other during an expansion stroke of the reversibly expandable structure 122. Drawing the inner and outer pivots together induces scissor action in the adjacent, pivotally connected basic modules that is likewise transmitted throughout each of the other modules of the reversibly expandable structure 122. Thus, it would be possible to reconfigure the reversibly expandable structure 122 between collapsed and expanded states by actuating a single basic module 130.

Although the first and second angled members 132*a*, 132*b* are illustrated as linear struts having the same basic angled shape, in some embodiments, they can have different shapes with respect to each other. Generally, the shapes of the first and second angled struts 132*a*, 132*b* control the shape of the reversibly expandable structure 122. By varying the relative shapes, different geometric structures can be obtained such as ellipses, polygons, and other arbitrary shapes. In the exemplary embodiment, all of the basic modules 130 of the reversibly expandable structure are identical. In some embodiments, one or more of the basic modules 130 can be different, again controlling the overall shape of the reversibly expandable structure 122. In some embodiments, one or more of the angled members can include a planar member such as a polygon. By including planar members, the reversibly expandable structure 122 can fill an area along the annular region covered by the reversibly expandable structure 122. This filled region can be used to occlude or block an opening.

Preferably, each of the angled members 132*a*, 132*b* of the basic module 130 are substantially rigid. Using rigid members 132*a*, 132*b* promotes transfer of force by the reversibly expandable structure 122*a* on an external body. Using rigid members 132*a*, 132*b* also promotes the reversibly expandable structure 122 maintaining its general shape during transitions between collapsed and expanded states. The angled members can be made from any suitable rigid material such as metals, alloys, polymers, composites, ceramics, glass, wood.

Figure 4:
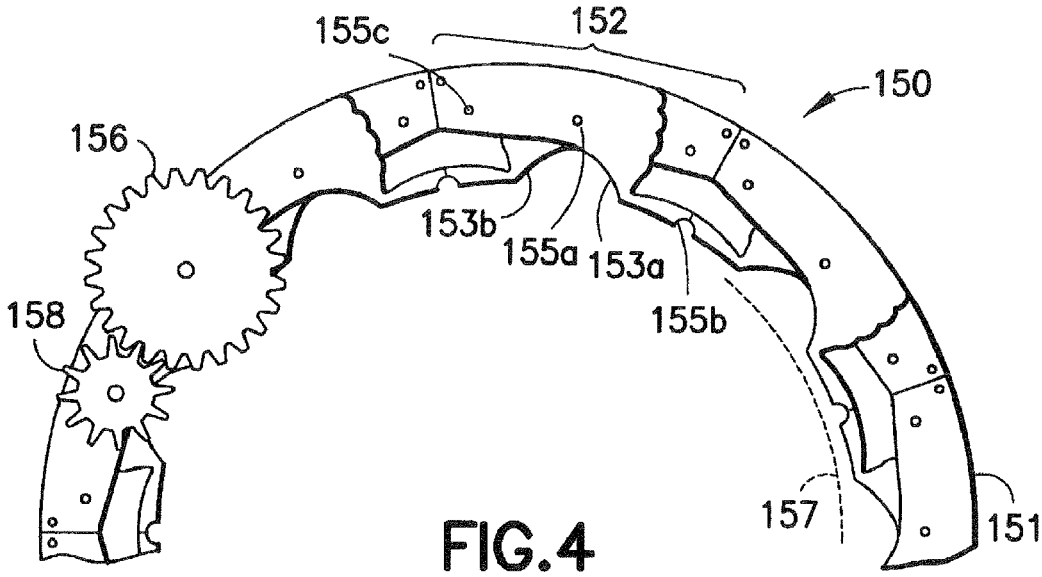
FIG. 4 illustrates a portion of an embodiment of a deployable structure system including a geared actuator linkage according to the present invention.

A portion of an exemplary embodiment of a circular reversibly expandable structure 150 is shown in FIG. 4. The reversibly expandable structure 150 is formed from an enclosed linkage of basic modules 152 having an outer perimeter 151 defined by a circular arc such that the joined basic modules 152 when fully expanded together form a continuous circular outer perimeter as shown. Each of the basic modules 152 includes a pair of substantially identical members 153*a*, 153*b* joined about a central pivot 155*a*, allowing a scissor action of the members 153*a*, 153*b*.

The reversibly expandable structure 150 can be transformed between collapsed and expanded states by a gear-driven actuator. In the exemplary embodiment, two gears 156, 158 are used in actuation of the device 150. The gears 156, 158 can be identically shaped or differently shaped. In the exemplary embodiment, a first gear 156 is larger than a second gear 158. The first and second gears 156, 158 mechanically engage each other such that rotation of one induces a rotation of the other. The relative angular velocities of the two gears 156, 158 are inversely related by their relative diameters.

At least one of the gears 156, 158 is fixedly coupled to one of the members 153*a*, 153*b* of the basic module 152. In the exemplary embodiment, the first gear 156 is fixedly coupled to one of the members 153*a* at its outer pivot 155*c*. Thus, rotation of the first gear 156 results in a corresponding rotation of the fixedly coupled member 153*a* about its pivot 155*a*.

The second gear 158 is rotatably coupled to at least the other member 153*b* of the basic module 152, being allowed to freely rotate. In the exemplary embodiment, the second gear 158 is rotatably coupled to the central pivot 155*a* of the member 153*a* of the basic module 152. Rotation of either one of the first and second gears 156, 158 applies a torque to the first member 153*a* with respect to the second member 153*b*, causing the members 153*a*, 153*b* to rotate with respect to each other about their central pivot 155*a*. By linkage of the basic actuated module 152 to adjacent basic modules forming the enclosed reversibly expandable structure 150, scissor action of the actuated basic module 152 induces similar scissor action in each of the other basic modules of the reversibly expandable structure 150. Thus, actuation of one of the basic modules 152 with the geared actuator can vary the reversibly expandable structure between its collapsed and expanded states.

Figure 5:
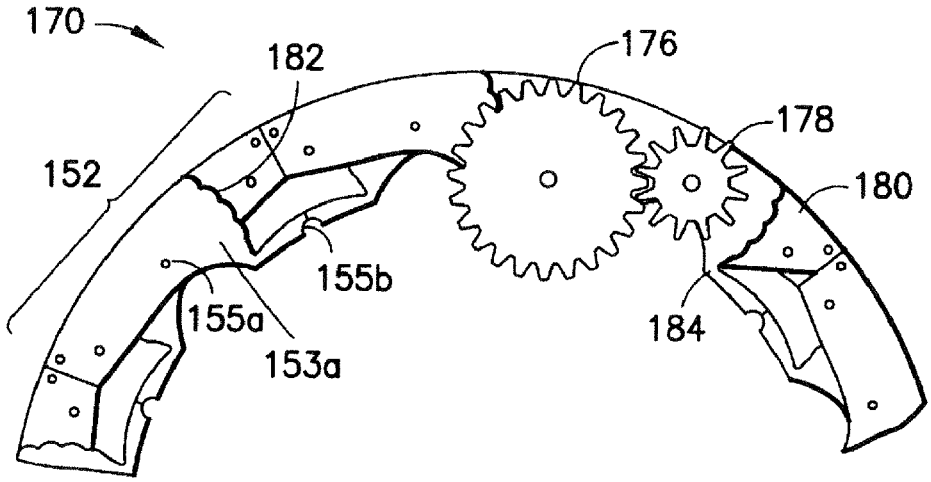
FIG. 5 illustrates a portion of another embodiment of a deployable structure system including a geared actuator linkage and a locking element according to the present invention.

Mounting the first, relatively large gear 156 about an external pivot 155*c* provides maximum clearance with respect to an internal aperture of an annular reversibly expandable structure 150, since a portion of the first gear 156 is positioned towards the outer perimeter 151. Such a configuration having maximum internal clearance is well suited for applications applying a force along an interior perimeter 157. An alternative embodiment of a similar reversibly expandable structure 170 is illustrated in FIG. 5, including a geared actuator configured to provide minimum interference with respect to an external perimeter. Such a configuration having minimum external interference is well suited for applications applying a force along an exterior perimeter 151.

In this embodiment, a second, relatively small gear 178 is rotatably coupled to one member 153*a* of the basic module 152 at its central pivot 160. A first, larger gear 176 is fixedly mounted to an internal pivot 155*b* of the other member 153*b* of the basic module 152. Rotation of the second gear 178 with respect to the first gear 176 induces a relative rotation of the members 153*a*, 153*b* of the basic module 152 about the central pivot 155*a*. Mounting the larger gear 176 with respect to the internal pivot 155*b* is preferred when the reversible structure 170 will be used for external loading. Thus, an external perimeter 151 of the reversibly expandable structure 170 can be applied to an external structure without interference of the larger gear 176. Of course, interference is also controlled by the diameters of the gears 156, 158 (FIG. 4), 176, 178 (FIG. 5), as well as the width of the annular members 153*a*, 153*b*.

In some embodiments, the reversibly expandable structure 170 includes one or more locking members 180. The locking members 180 can be used to lock the reversibly expandable structure 170 at one or more configurations between expanded and collapsed states to prevent further expansion or collapse of the structure 170. In some embodiments, the locking member 180 can be used to lock the reversibly expandable structure 170 in a fully expanded position. Alternatively or in addition, the locking member 180 can be used to lock the reversibly expandable structure 170 in a fully collapsed position. In some embodiments, the locking member 180 can be used to lock the reversibly expandable structure 170 in a selectable intermediate state between fully expanded and fully collapsed states.

In the exemplary embodiment, one or more of the angled members 153*a*, 153*b* of a basic module include a lockable surface 182. For example, the locking surface can include a locking surface 182 along one end of a first angled member 153*a* of the basic module 152. A separate locking member 180 is provided adjacent to the locking surface 182 and configured to engage the locking surface 182. In the exemplary embodiment, the locking surface 182 is a ratchet surface 182. The locking member includes a pawl 184 positioned to engage the ratchet surface 182, allowing movement in one direction, while preventing movement in an opposite direction. The ratchet surface 182 and the pawl 184 can be configured in a preferred direction to prevent collapsing of the reversibly expandable structure 170 while allowing further expansion, as illustrated. Alternatively, the ratchet surface 182 and pawl 184 can be configured in an opposite sense to prevent further expansion of the reversibly expandable structure 170 while allowing further collapse. In the exemplary embodiment, the locking member 180 is pivotally joined to at least one of the angled members 174*a*, 174*b*. In some embodiments, the locking member 180 can be a separate component that is used to engage one or more of the angled members 153*a*, 153*b*. For example, a locking member can include a pin or elongated rigid member that is insertable in an aperture of one or more of the angled members 153*a*, 153*b*. When the pin is inserted, further rotation of one of the members with respect to the other is prohibited, thereby locking the basic module 172 in its current state of deployment. A single locking member can be used to lock the entire reversibly expandable structure. In other embodiments, more than one locking members are used to provide greater strength. For example, a respective locking member can be provided for each of the basic modules 152.

Figure 6A:
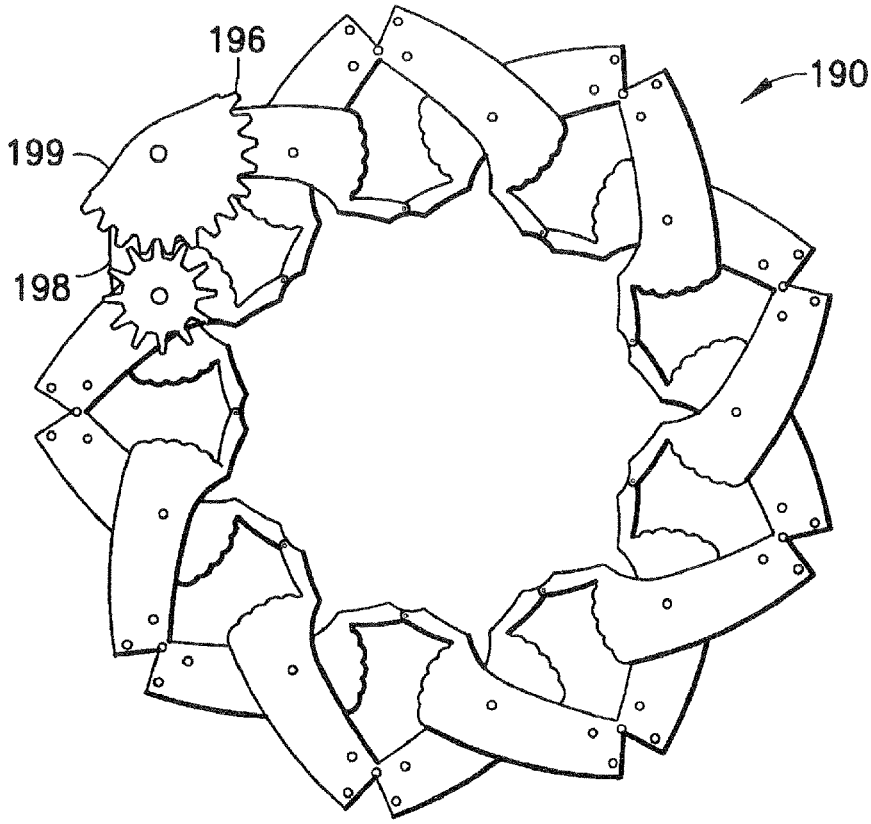
FIG. 6A illustrates yet another embodiment of a deployable structure system including a geared actuator linkage in partially expanded state according to the present invention.
Figure 6B:
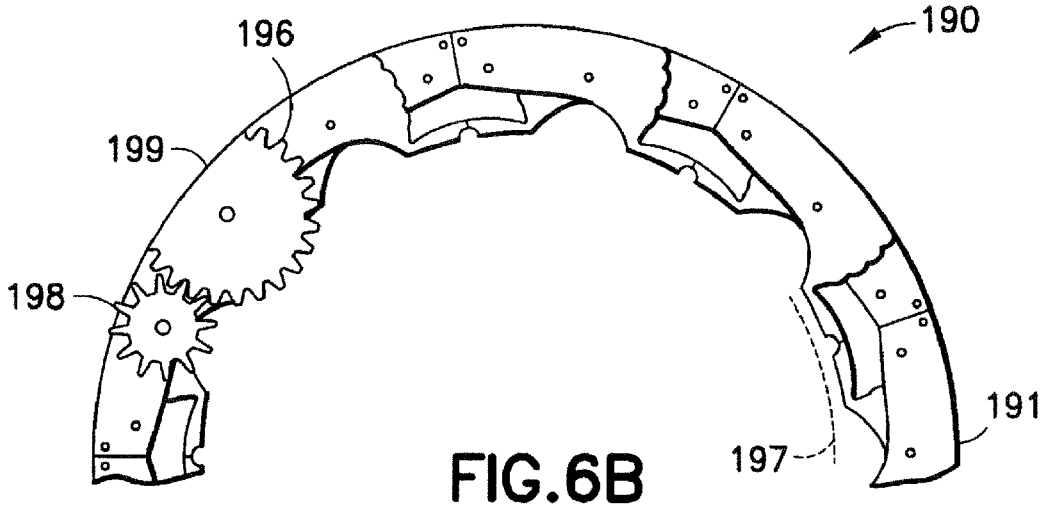
FIG. 6B illustrates a portion of the embodiment of the deployable structure system of FIG. 6A.

FIG. 6A and FIG. 6B illustrate another embodiment of a reversibly expandable structure 190 including a geared actuator. In this embodiment, a larger gear 196 is shown with an unused portion of the gear being removed providing a smooth surface 199. Removal of the unused portion of the larger gear 196 can benefit by allowing full expansion of the reversibly expandable structure without any portion of the larger gear extending beyond an outer perimeter 191 of the reversibly expandable device 190. The larger gear 196 can be coupled to the inner or outer pivots, provided that sufficient portion of the gear 196 is removed to prevent interference. Such treatment of the larger gear 196 allows use of larger gears having diameters greater than would otherwise be possible, allowing for a greater mechanical advantage. In some embodiments, the smooth surface 199 is aligned with an interior perimeter 197 to prevent interference along the interior.

Figure 7:
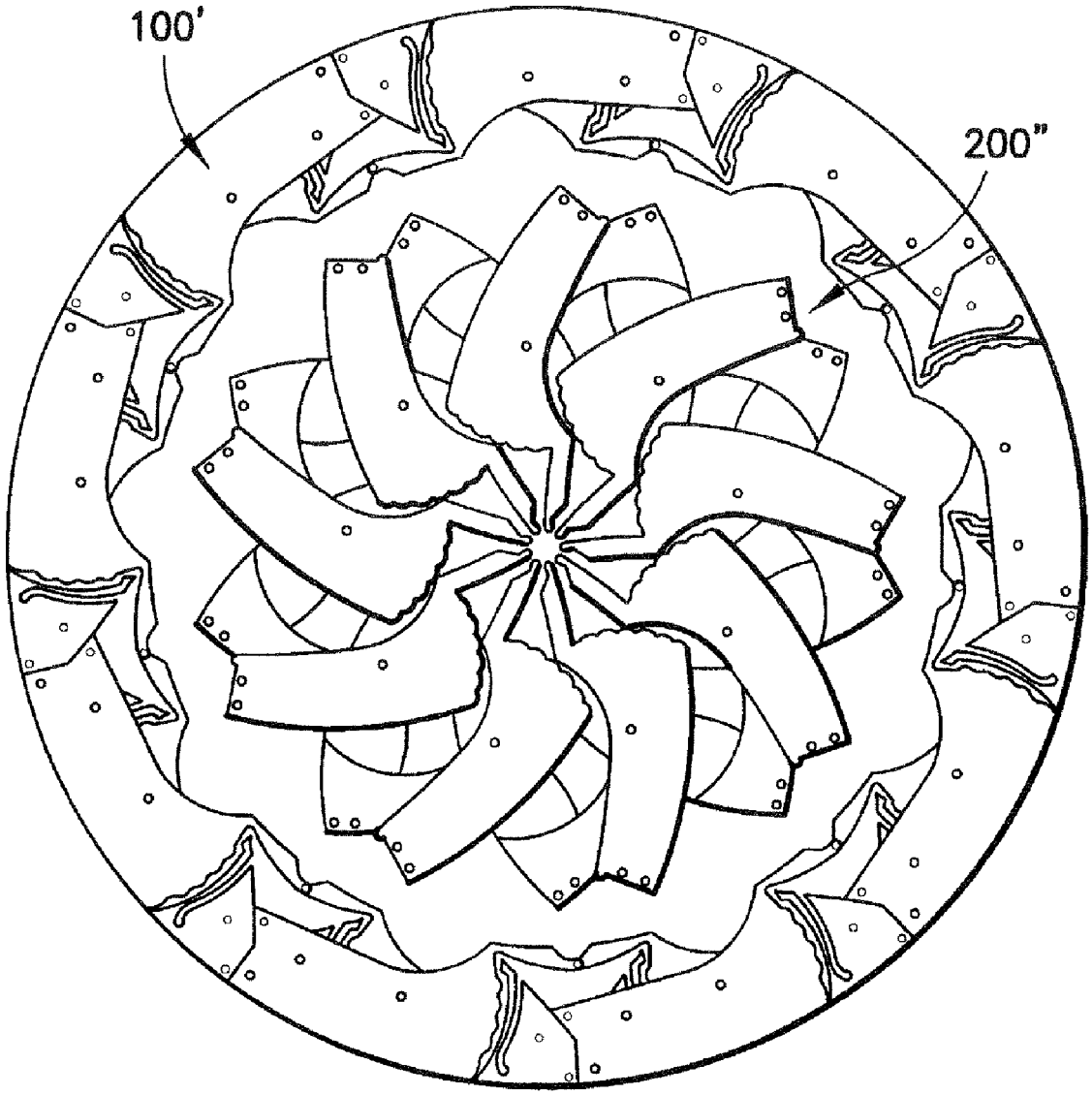
FIG. 7 illustrates a planar view of one embodiment of a first deployable structure of the deployable structure system according to the present invention in an expanded state with a similar second deployable structure in a collapsed state.

FIG. 7 illustrates a planar view of one embodiment of a first deployable structure according to the present invention in an expanded state 200' with a similar second deployable structure 200" in a collapsed state. In some embodiments, the reversibly expandable structures 200', 200" (generally 200) are configured such that an outer diameter in a collapsed state is less than an inner diameter in an expanded state (i.e., referring to FIG. 1, OD1<ID2) such that the collapsed structure 200" is able to pass completely within an interior aperture of the expanded structure 200' as shown.

Figure 8B:
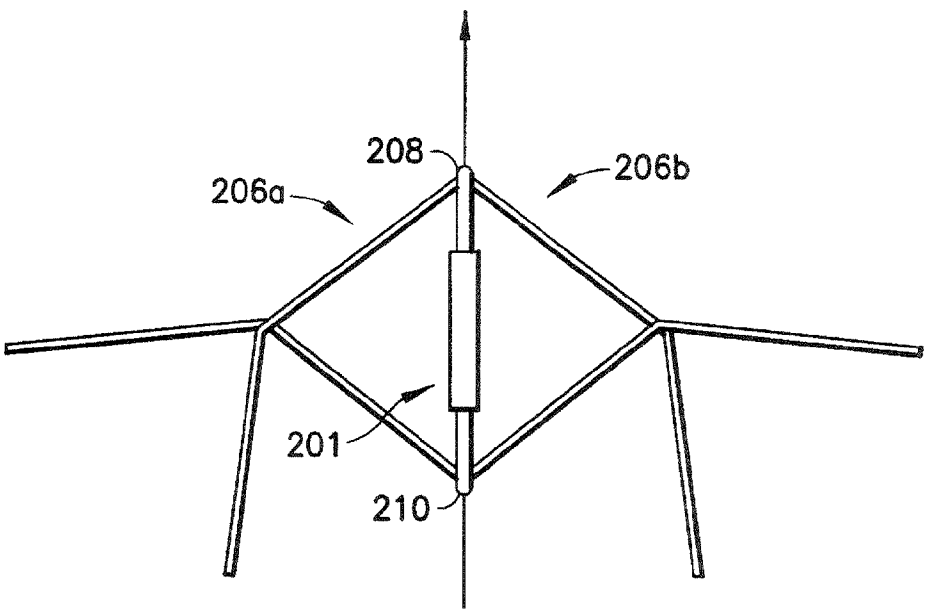
FIG. 8A and FIG. 8B respectively illustrate an exemplary angulated element including a linear actuator in a collapsed state and in an expanded state.
Figure 8A:
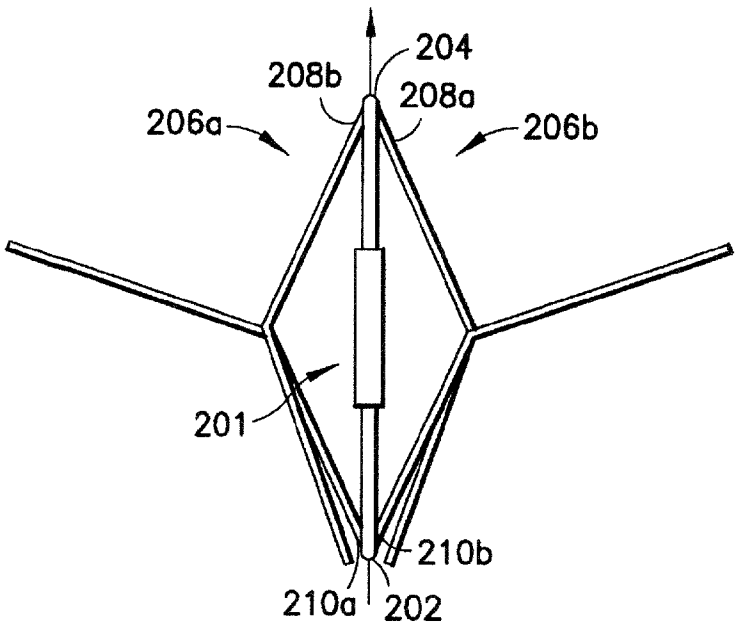

In some embodiments, a linear actuator is used to induce a torque causing pivoting of the basic modules and inducing the transition in a reversibly expandable structure between collapsed and expanded states. FIG. 8A and FIG. 8B illustrate an exemplary embodiment including a linear actuator 201. A portion of a reversibly expandable structure is illustrated including a first basic module 206*a* joined to a second basic module 206*b*. An outer right-hand pivot 208*b* of the first basic module 206*a* is joined to an outer left-hand pivot 208*a* of the second basic module 206*b*. Likewise, an inner right-hand pivot 210*a* of the first basic module 206*a* is joined to an inner left-hand pivot 210*b* of the second basic module 206*b*. The linear actuator 201 can be joined between the outer and inner pivot points 208, 210 of the adjacent basic modules 206*a*, 206*b*.

The linear actuator 201 includes an outer end 204 coupled to the outer pivot point 208 and an inner end 202 coupled to the inner pivot point 210. The linear actuator 201 is configured to vary in length according to an input signal. The exemplary linear actuator 201 is illustrated in an extended state providing maximum separation of the interior and exterior pivot points 208, 210. By extending the interior and exterior pivot points 210, 208 of the adjacent basic modules 206*a*, 206*b*, the exemplary reversibly expandable structure is transformed to a collapsed state as shown in FIG. 8A. The linear actuator 201 can be configured in a contracted state as shown in FIG. 8B. In the contracted state, the linear actuator 201 draws the interior pivot point 210 towards the exterior pivot point 208. By drawing the interior and exterior pivot points towards each other, the reversibly expandable structure is transformed into its expanded state.

The linear actuator 201 is a length adjustable, or length-changing device. Such length-changing devices can be mechanical, electrical, electromechanical, hydraulic, or pneumatic. For example, a linear actuator 201 can include a piston driven by pneumatic or hydraulic action between extended and contracted states. In other embodiments, the linear actuator can include a bolt-and-screw drive. For example, an elongated threaded shaft can be aligned between the pivot points. Each of the pivot points is coupled to the elongated threaded shaft through a bolt. Rotation of the threaded shaft causes linear displacement of the bolts along the length of the shaft according to the direction of rotation and the orientation of the threads. In other embodiments, the linear actuator includes a solenoid device. Electrical activation of a coil causes linear displacement of a bolt through the coil, thereby achieving extended and contracted states depending on activation of the coil. In some embodiments, the linear actuator 201 includes a linear motor such as a Lorentz force actuator. Position of the Lorentz force actuator is configurable between extended and contracted lengths and selectable lengths therebetween according to an activation signal provided to the coil. In some embodiments, the linear actuator 201 includes a phase-change material, such as a shape memory alloy. The linear actuator 201 may also contain piezoelectric devices configured to alter a length of the linear actuator 201.

Figure 9A:
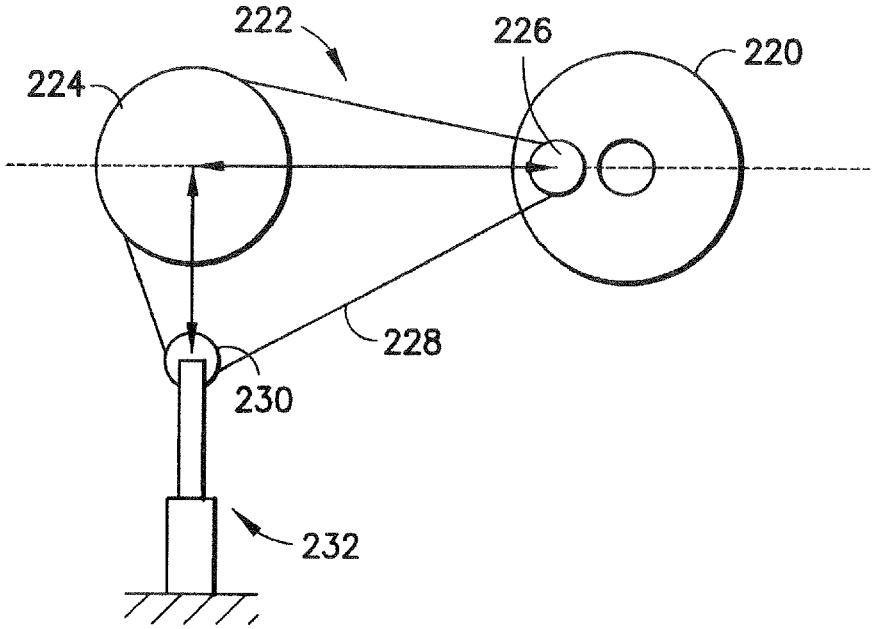
FIG. 9A and FIG. 9B respectively illustrate a schematic diagram of a deployable structure system with a belt and pulley drive actuator according to the present invention in collapsed and expanded states.
Figure 9B:
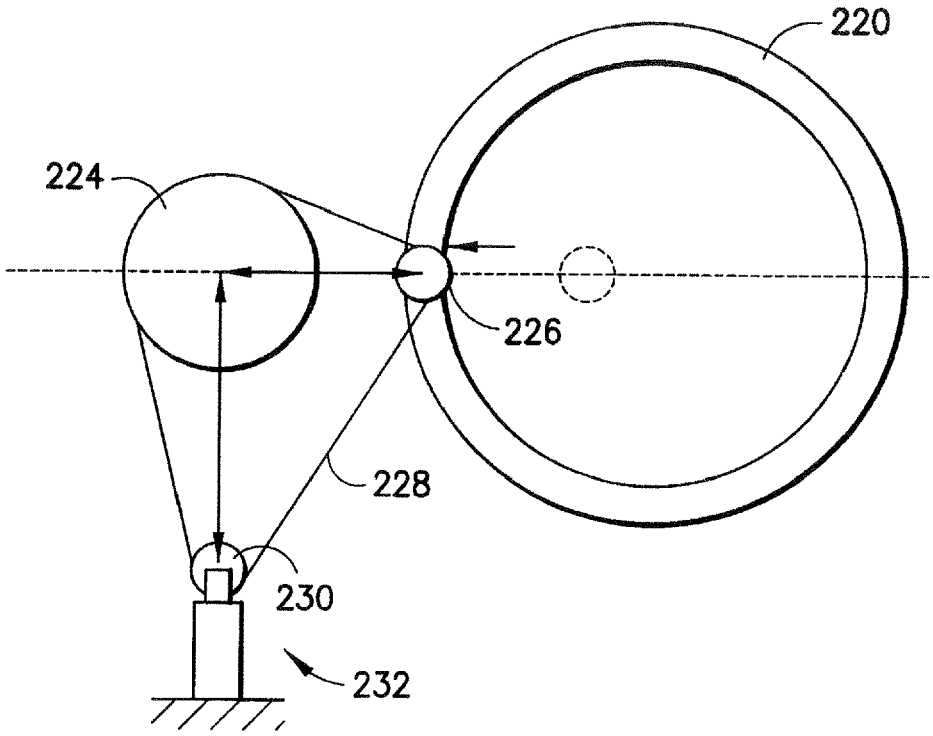

Referring now to FIG. 9A and FIG. 9B, a rotary actuator is coupled to a reversibly expandable device 220 through a belt-and-pulley mechanical linkage 222. The rotary actuator is coupled to a driving pulley 224. A driven pulley 226 is coupled to the reversibly expandable structure 220 such that rotation of the driven pulley 226 provides a torque rotating a basic module of the reversibly expandable structure 220. The applied torque can be in either direction controlling expansion or contraction of the reversible structure 220. The driving pulley 224 is coupled to the driven pulley 226 through a drive belt 228.

The reversibly expandable structure 220 is shown in a collapsed state in FIG. 9A. As the rotary actuator rotates the driving pulley 224 in one direction, the driven pulley 226 is rotated in the same direction by the drive belt 228. Rotation of the driven pulley 226 applies a torque to the reversibly expandable structure 220 causing the reversibly expandable structure 220 to transition to an expanded state as shown in FIG. 9B. In the exemplary embodiment, the driving pulley 224 and driven pulley 226 are aligned along a radius of the reversibly expandable structure 220. As the reversibly expandable structure 220 increases its radial dimension, the driven pulley 226 attached to the reversibly expandable structure 220 is translated along the radius as shown. When the driving pulley 224 is maintained at a fixed location with respect to the reversibly expandable structure 220, such translation of the driven pulley 226 along the radius will introduce a slack in the drive belt 228.

In order to maintain a tension within the drive belt 228, a tension pulley 230 is provided in communication with the drive belt 228. The tension pulley is orthogonally displaced from the radius joining the driving pulley 224 and the driven pulley 222. The tension pulley 230 is rotatably coupled to a length-adjustable device 232. The length-adjustable device 232 can include an elongated member rotatably coupled to the tension pulley 230 at one end and fixedly coupled at an opposite end with respect to a center point of the reversibly expandable structure 220. With the reversibly expandable structure 220 in a collapsed state, the driven pulley 226 is maximally displaced from the driving pulley 224 along the radius. The length-adjustable device 232 is maximally extended such that the tension pulley 230 is relatively close to the radius. As the reversibly expandable structure 220 transitions to an expanded state, the driven pulley 226 migrates toward the driving pulley 224. In order to maintain belt tension, the length-adjustable device 232 is adjusted to a minimum length such that the tension pulley 230 takes up slack within the belt 228. In some embodiments, the length adjustable device includes a spring. Alternatively or in addition, the length adjustable device includes a piston, which may be hydraulic or pneumatic, a belt-and-screw drive, a solenoid, a linear motor, a phase change material, such as a shaped memory allow, or a combination of one or more of these devices. Although the exemplary embodiment has been described in the configuration of a belt-and-pulley drive, a similar actuator could be accomplished with a chain-and-sprocket drive. Thus, the pulleys 224, 226, 230 would be replaced by sprockets and the drive belt 228 would be replaced by a drive chain.

Figure 10A:
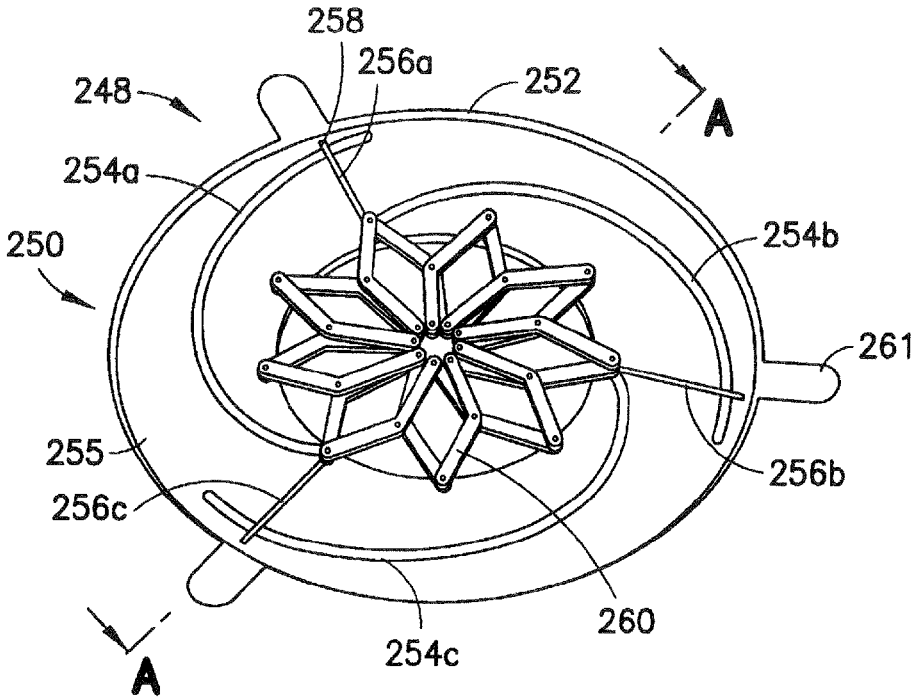
FIG. 10A illustrates a perspective view of a rotary disk actuator configured to actuating a deployable structure according to the present invention.

In some embodiments, referring now to FIG. 10A, an actuatable deployable structure system 248 includes a reversibly expandable structure 260 and a rotatable disk actuator 250. The rotatable disk actuator 250 includes a first disk 252 having one or more rotating tracks 254*a*, 254*b*, 254*c* (generally 254). The rotatable disk actuator 250 also includes a second disk 255 including one or more radial tracks 256*a*, 256*b*, 256*c* (generally 256). An overlap 258 of one or more of the rotary tracks 254 with a respective radial tracks 256 of the second disk 255 results when the first and second disks 252, 255 are placed adjacent to each other.

One or more fixed points on the reversibly expandable structure 260 are configured for capture by the overlap 258. Rotation of the first disk 252 with respect to the second disk 255 results in a controlled translation of each overlap 258 along its respective radial track 256. Resulting translation of the overlap 258 is coupled to the fixed point on the reversibly expandable structure 260. Translation of the fixed point applies a torque to a respective basic structure 262 of the reversibly expandable structure 260. Thus, rotation of the first disk 252 with respect to the second disk 255 can be used to control transformation of the reversibly expandable structure 260 between collapsed and expanded states.

In an illustrative embodiment including a rotatable disk actuator 250, the first disk 252 includes three right-hand spiral tracks 254*a*, 254*b*, 254*c* spaced apart from each other by 120°. The second disk 255 includes three radial tracks 256*a*, 256*b*, 256*c* also spaced apart from each other by 120°. The length of the radial tracks 256 can be sufficient to cover full radial displacement of the spiral tracks 254. In some embodiments, the spiral tracks 254 are slotted apertures cut through from one side of the disk 252 to the other. In other embodiments, the spiral tracks 254 are grooves formed along a surface of the first disk 252 facing the second disk 255. The radial tracks 256 can also be slotted apertures cut from one side of the second disk to the other. Generally, at least one of the spiral tracks 254 and radial tracks 156 is a through aperture extending from one side of the respective disk to the other. The other of the spiral tracks 254 and radial tracks 156 can be a through aperture, or a groove.

In some embodiments, fixed points on the reversibly expandable structure 160 aligned with respective overlaps 258 coincide with pivot points of the reversibly expandable structure 260. An extension of such a pivot point can be extended to pass through an adjacent radial slot 256 and extend into a corresponding spiral slot 254 at the overlap 258. When the reversibly expandable structure is positioned along an opposite side of the actuator 148, the extension of the pivot point can be extended to pass through an adjacent spiral slot 154 and extend into a corresponding radial slot. Thus, as the first disk 252 is rotated with respect to the second disk 255, the overlap is captured to one of the pivot points through the extended joint such that the pivot point is translated in a radial direction. In this manner, the reversibly expandable structure 260 can be transformed between its collapsed and expanded states, depending upon the orientation of the spiral (right-hand or left-hand spiral) and the direction of relative rotation of the disks 252, 255.

Figure 10B:
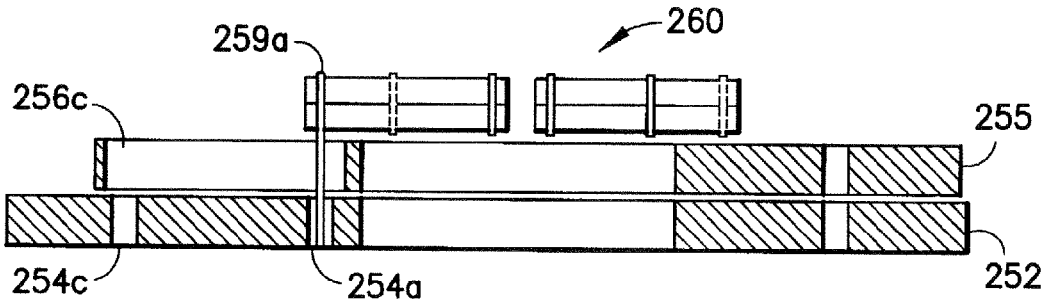
FIG. 10B is a cross sectional view of the rotary disk actuator of FIG. 10A along A-A.

A cross-section of the exemplary system including the rotatable disk actuator 250 taken along A A is illustrated in FIG. 10B. In the exemplary embodiment, the first disk 252 is shown as a base with the second disk 255 layered upon a top surface. The reversibly expandable structure 260 is positioned along an opposite surface of the second disk 255, such that the second disk 255 is sandwiched between the reversibly expandable structure 260 and the first disk 252 as shown. Several joints of the reversibly expandable structure 260 are shown with one of the joints 259 including an extension directed toward the first and second disks 252, 255. The extension is aligned through a first radial slot 256*c* and extending into a corresponding first spiral slot 254*a*. In this manner, a pivot 259 of the reversibly expandable structure 260 is captured by an overlap of the radial track 256 and the spiral track 254.

In some embodiments, one of the disks includes a feature to facilitate relative rotation of the disks 252, 255. In the exemplary embodiment, the first disk 252 includes three tabs 261 that can be used as bearing surfaces to rotate the bottom disk 255. In some embodiments, one of the disks is fixedly mounted to an external structure. In other embodiments, both disks 252, 255 includes tabs 261. Alternatively or in addition, one or more of the first and second disks 252, 255 can include a gear surface along an external or internal perimeter. The geared surface is engagable by another gear coupled to motor providing a torque for rotating at least one of the disks 252, 255.

Figure 11:
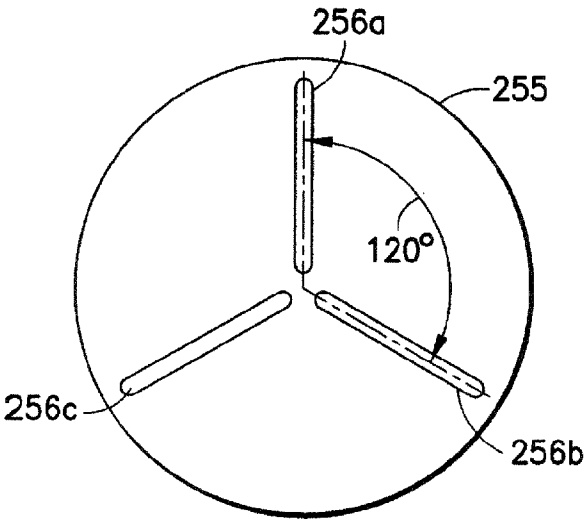
FIG. 11 illustrates a planar view of an exemplary fixed disk of the rotary disk actuator of FIG. 10A.

FIG. 11 illustrates the second disk 255 including three radial slots 256*a*, 256*b*, 256*c* extending outward from a center portion of the disk 255 and spaced apart from each other by 120°. In some embodiments, different numbers of radial slots can be provided. The second disk 255 is preferably formed from a rigid material to maintain its shape during operation providing a straight radial slot.

Figure 12A:
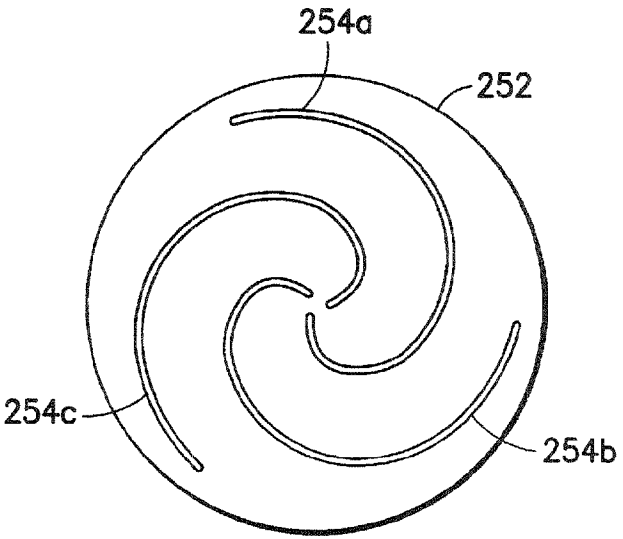
FIG. 12A and FIG. 12B illustrate planar views of different embodiments of rotary disks of the exemplary rotary disk actuator FIG. 10A.

FIG. 12A illustrates an embodiment of the first disk 252 including three right-hand spiral slots 254*a*, 254*b*, 254*c*. Each spiral slot 254 extends from a first radius near the center of the disk 252 to a second radius approaching an external perimeter of the disk as shown. The particular spiral slot 254 can be defined in polar coordinates as a function of the angle about a center of the disk 252. In this embodiment, a complete spiral slot 254 extends for about 240° of rotation.

Figure 12B:
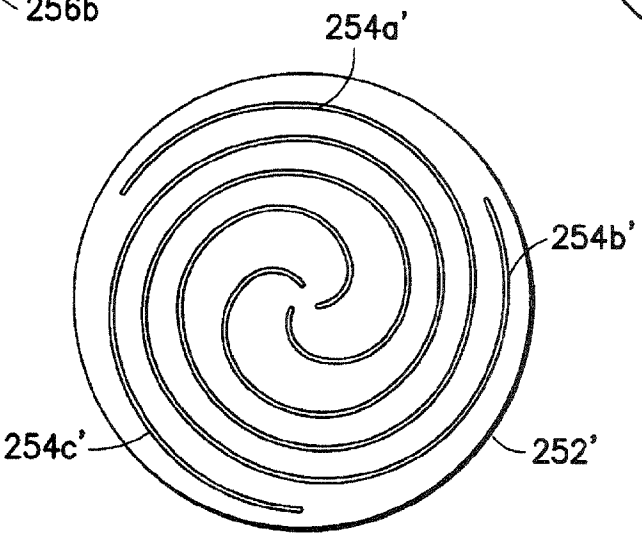

A second embodiment of the first disk 252' is illustrated in FIG. 12B, also including three spiral slots 254*a*', 254*b*', 254*c*' (generally 254'). Each spiral slot 254' also extends from the first radius near the center of the disk 252' to a second radius approaching an external perimeter of the disk 252'. However, each spiral slot 254' extends for approximately 570° of rotation. The particular shapes of the spirals slots 254' can be defined in polar coordinates as a function of angle that can be selected according to a particular application. In some embodiments, the spirals correspond to a rotary wedge and provide a mechanical advantage similar manner to a wedge. Thus, the spirals 254 of the embodiment of the first disk 252 shown in FIG. 12A correspond to a wedge having a relatively steep slope whereas the spirals of the second embodiment of the first disk 252' illustrated in FIG. 12B correspond to a wedge having a relatively shallow slope.

On rotation, the spiral shape of the first disk 252 will push the joints along the radial slots of the second disk 255, deploying the structure. In some embodiments the second disk 255 is fixed in place, while the first disk 252 is rotated. A torque is applied to the first disk 252 to cause its rotation. Energy conservation dictates that the speed of expansion of the deployable device is inversely proportional to the force of expansion F.

$$\dot{\theta}_{rotating} \cdot \tau_{rotating} = \dot{R}_{device} \cdot \sum |F_{device}|$$

$$\rightarrow \dot{R}_{device} = \dot{\theta} \frac{\tau_{rotating}}{\sum |F_{device}|},$$

where the quantity after θ is the ratio of the torque exerted on the system to the force exerted on the device. This ratio is the force multiplication ratio, which can be altered by changing the shape of the slotted paths of the first, rotating disk 252. For example, a rotating disk with slotted paths that have a length several times that of the disk's radius will produce a large expansion force, but will subsequently require multiple rotations of the disk to fully expand the device. With a function of the slotted path defined in polar coordinates, $r=f(\theta)$. The derivative of the path radius with respect to θ also provides the torque multiplication factor. A disk that produces a constant force multiplication regardless of expansion in diameter has the slotted path equation of $r=a\cdot\theta$.

A plane view of an exemplary rotatable disk actuator 250 is illustrated in FIG. 13. A second disk 255 is placed upon the first disk 252 aligned concentrically. The overlapping intersections 258*a*', 258*a*", 258*b*', 258*b*", 258*c*', 258*c*" (generally 258) of the rotating tracks 254 and the radial tracks 256 are shown. An extension of a respective one of the pivotal joints 259*a*, 259*b*, 259*c* (generally 259) of the reversibly expandable structure 260 is shown disposed within an inner one of each of the inner overlapping intersections 258 of each radial track 256. Rotation of the second disk 255 with respect to the first disk 252 in the direction of the angle θ shown, translates the overlapping intersections 258 outward from the center of the disks, along the radial tracks 256. This outward movement of the intersection 258 applies an outward directed force to the pivotal joint extension 259 captured within the overlapping intersection 258. A respective outward force is provided in each of the pivotal joint extensions captured within the overlapping intersections 258 which in turn actuates the deployable structure 260 (not shown). For example, the outward directed force transforms a reversibly expandable structure 260 from a collapsed to an expanded state. This represents a so-called expansion stroke that in turn can apply a force through the expandable structure 260 to do work.

Figure 13A:
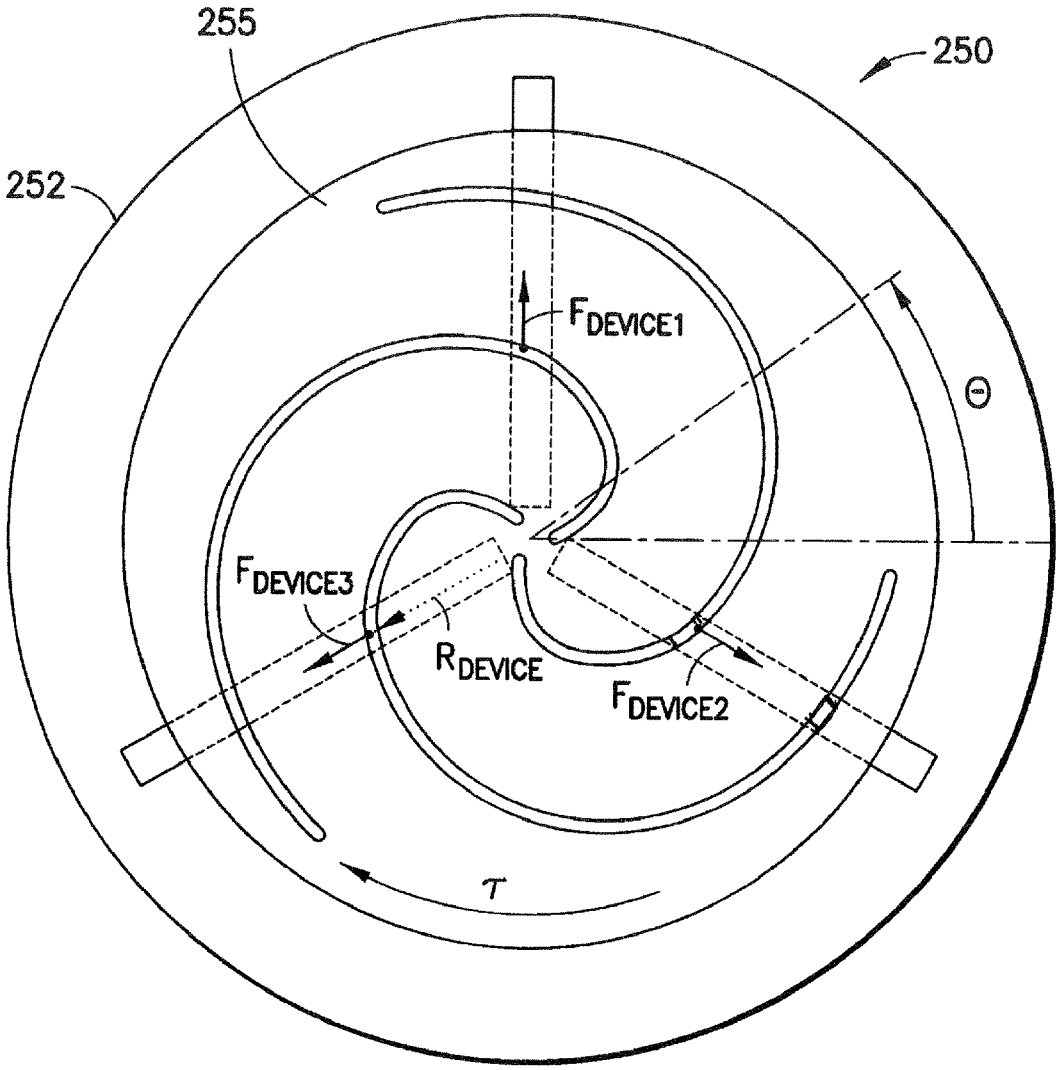
FIG. 13A, FIG. 13B, FIG. 13C, and FIG. 13D are planar views of the exemplary rotary disk actuator of FIG. 10A in different stages of actuation.
Figure 13B:
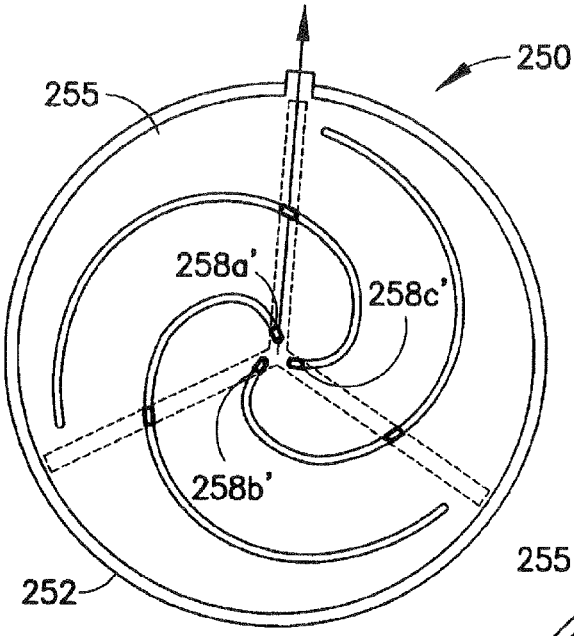
Figure 13C:
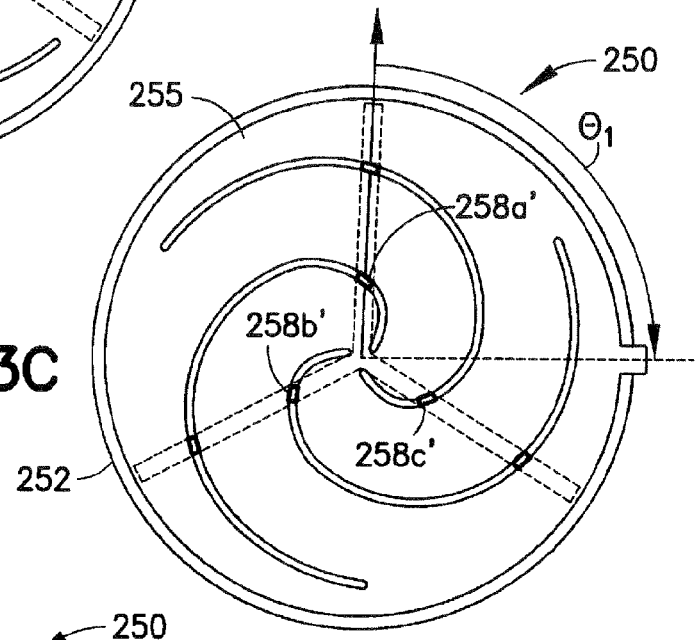
Figure 13D:
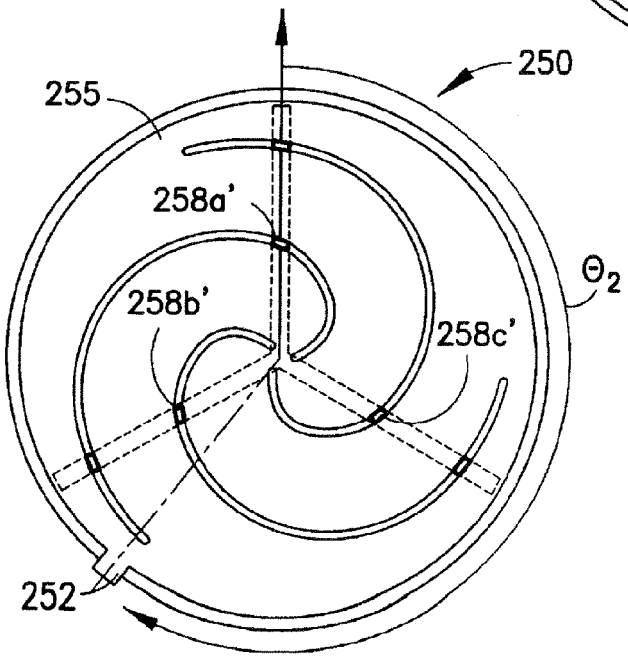

FIG. 13B, FIG. 13C, and FIG. 13D together illustrate three different rotations of the first and second disks 255, 252 with respect to each other also showing the overlapping intersections 258 with each orientation. For example, FIG. 13B can illustrate a collapsed configuration in which the overlapping intersections 259 are disposed at a minimum radius in the inner overlapping intersections 258' with respect to the disks 255, 252. FIG. 13C illustrates a partially expanded configuration, after a rotation of angle θ1 in which the inner overlapping intersections 258' are located midway along the radial tracks 256. FIG. 13D illustrates a fully expanded configuration, after a rotation of angle θ2 in which the inner overlapping intersections 258' are maximally positioned along the radial tracks 256.

Figure 14B:
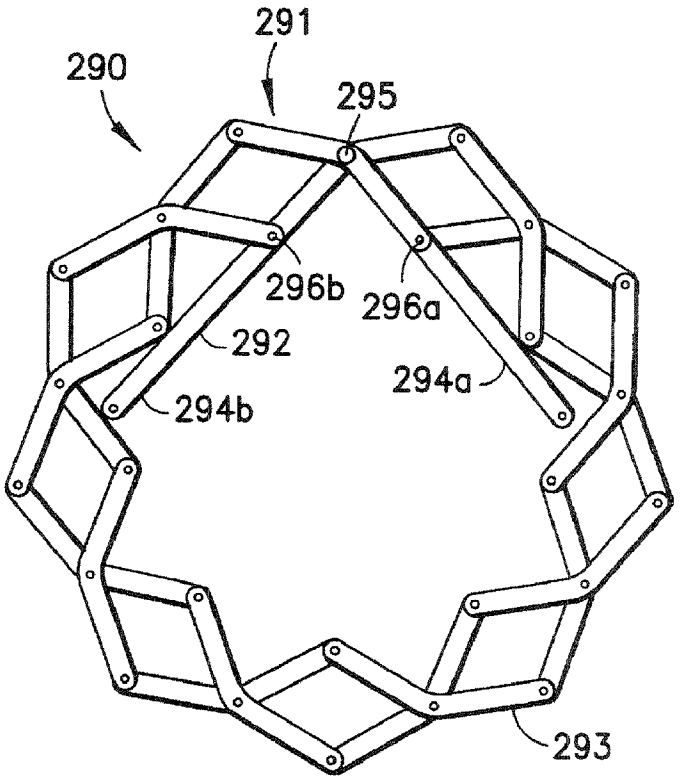
FIG. 14B illustrates an embodiment of a deployable structure system including an internal lever actuator according to the present invention.
Figure 14A:
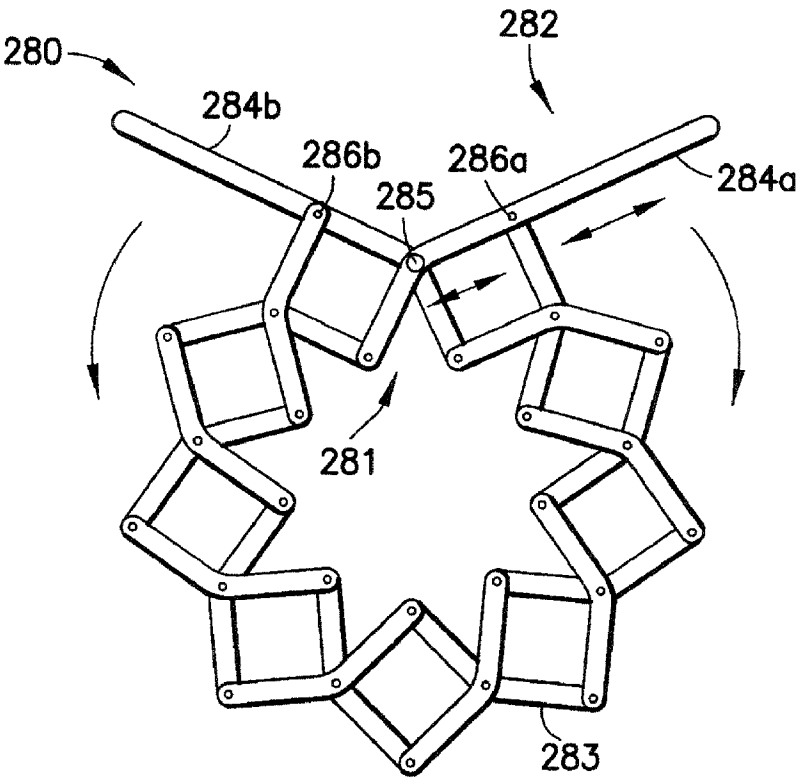
FIG. 14A illustrates an embodiment of a deployable structure system including an external lever actuator according to the present invention.

An exemplary embodiment of a reversibly actuatable expandable structure 280 including an reversibly expandable enclosed mechanical linkage having a lever-type actuator 282 is shown in FIG. 14A. In this embodiment, a pair of lever 284*a*, 284*b* (generally 284) are included in at least one of the basic modules 281. For example, the levers 284 can be formed from extensions of the angular members of the basic module 281. As shown in this example, the levers 284 extend outward from the outer pivot points 286*a*, 286*b* of the basic module 281. A torque applied to the levers 284 is directly transferred to the angled elements of the basic module 281 causing their rotation about the central pivot 285. The ends of the levers can be forced towards each other, urging the basic module 281 into a collapsed configuration. By its interconnection to other basic modules of the reversibly expandable structure 283, the structure 283 itself is urged into a collapsed state. Applying an operative directed torque urging the ends of the levers away from each other transitions the basic module 281 to an expanded configuration thereby causing the reversibly expandable structure 283 to transition to its expanded state. With the levers disposed externally to the reversibly expandable structure, the configure is better suited for applying force internal to the structure. Actuation of the levers can be accomplished manually, or preferably with a length adjustable device, such any of the linear actuators 201 described in relation to FIG. 8A and FIG. 8B.

An alternative configuration of a reversibly actuatable expandable structure 290 including an reversibly expandable enclosed mechanical linkage 293 having a lever-type actuator 292 is illustrated in FIG. 14B. The lever-type actuator 292 also includes lever extensions 294*a*, 294*b* (generally 294) that extend inwardly from inner pivot points 296*a*, 296*b* along each of the angled elements of the basic module 291. Applying a torque urging the lever ends 294 together transitions the reversibly expandable structure 293 to a collapsed state, whereas urging the ends of the levers 294 apart from each other transitions the reversibly expandable structure 293 to an expanded state. Such configurations with levers 294 positioned along the inner portions of the reversibly expandable structure 293 are well-suited for applications in which a force is to be applied along an external perimeter of the reversibly expandable structure 293. In either configuration of the lever-type actuators 284, 294, it is important to note that the pivot point 285, 295 of the actuated basic module 281, 291 moves along a radius with respect to a center of the reversibly expandable structure 283, 293. Such actuation may be challenging for applications in which the reversibly expandable 283, 293 structure is to remain centered about a fixed location. At least one or both of the lever-type actuators 284, 294 and the reversibly expandable structure 283, 293 will tend to move during actuation. In order to maintain the expandable structure fixed, the pivot point of the lever-type actuators 284, 294 would have to travel along the radius according to the rate of expansion or contraction of the reversibly expandable structure 283, 293.

Figure 15B:
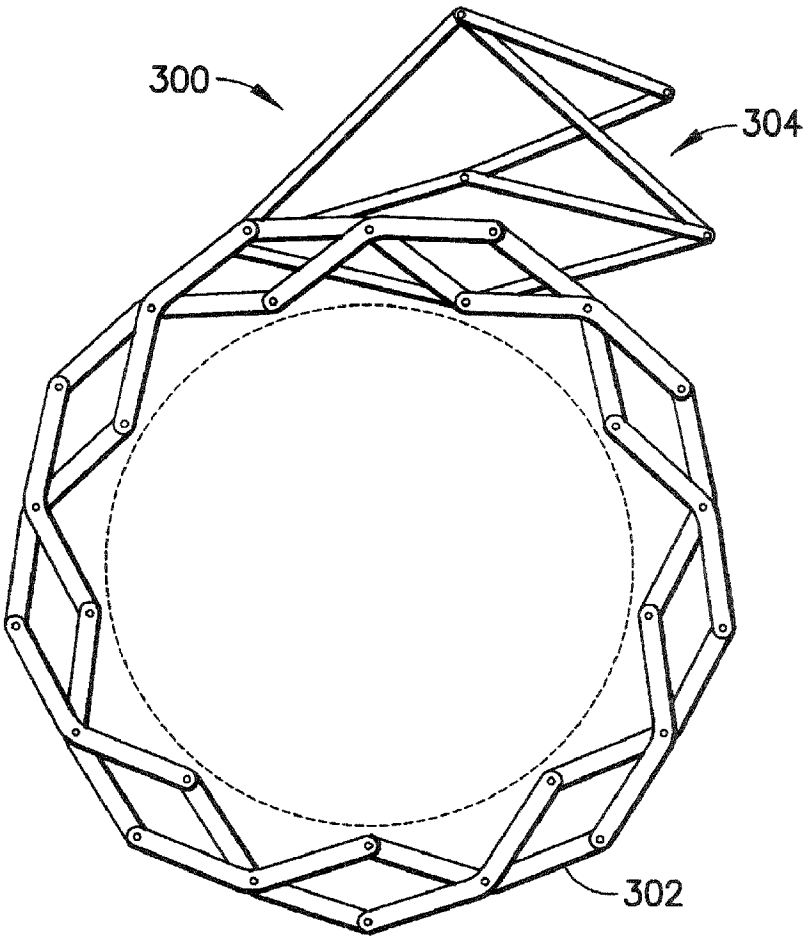
FIG. 15A and FIG. 15B respectively illustrate a planar diagram of an embodiment of a deployable structure system with an embodiment of an external Peaucellier-Lipkin type actuatable linkage according to the present invention in collapsed and expanded states.
Figure 15A:
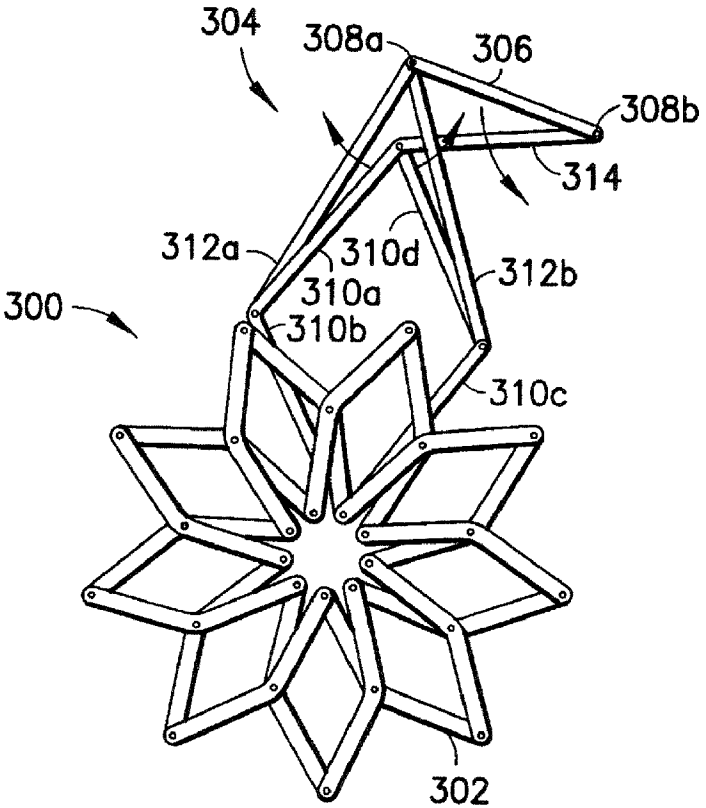

There exists at least one class of external linkages configured to convert rotary motion to linear motion referred to as Peaucellier-Lipkin linkages. FIG. 15A illustrates an exemplary embodiment of an actuatable deployable structure system 300 including a reversibly expandable structure 302 coupled to an external Peaucellier-Lipkin type actuatable linkage 304. The actuatable linkage 304 includes a fixed baseline 306 separating two pivot points 308*a*, 308*b*, and a pivotal linkage of seven rigid struts. Four struts of equal length 310*a*, 310*b*, 310*c*, 310*d* (generally 310) are arranged in a parallelogram pivotal about its corners. One corner is attached to the reversibly expandable device 302, for example at one of its internal pivot points. Two other equal length struts 312*a*, 312*b* (generally 312) are each coupled at one end to a first pivot point 308*a* of the baseline 306, and at an opposite end to opposing corners of the parallelogram 310. A seventh strut 314 is coupled between a fourth corner of the parallelogram 310 and a second pivot point 308*b* of the baseline 306. The corners of the parallelogram 310 coupled to the seventh strut 314 and the reversibly expandable structure 302 can be revered to as radial corners, since they lie on a radius of the expandable structure 302. The other two corners of the parallelogram 310 can be referred to as tangential corners.

Rotation of the seventh strut 314 about the second pivot point 308*b* urges the attached radial corner of the parallelogram 310 towards a center of the reversibly expandable structure 302. Since the baseline is fixed 306 with respect to the reversibly expandable structure 302, and the tangential corners of the parallelogram 310 are pivotally connected to the first pivot point 308*a*, the opposite radial corner of the parallelogram 310 is drawn radially out from the center of the reversibly expandable structure 302. Thus, rotation of the seventh strut 314 about its pivot 308*b* results in a linear motion of an inner radial corner along a radius of the reversibly expandable structure 302. Beneficially, the reversibly expandable structure remains centered about the same point during transformation between expanded and collapsed states. The actuatable deployable structure system 300 is shown in an expanded state in FIG. 15B.

Figure 16B:
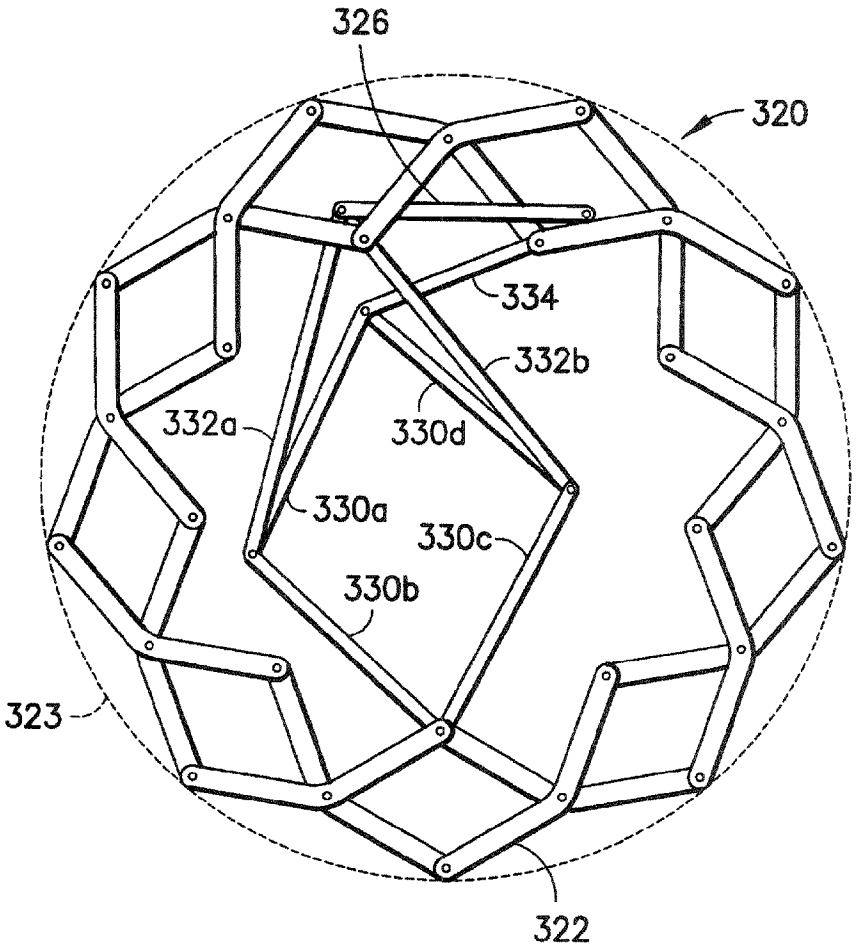
FIG. 16A and FIG. 16B respectively illustrate a planar diagram of an embodiment of a deployable structure system with an embodiment of an internal Peaucellier-Lipkin type actuatable linkage according to the present invention in collapsed and expanded states.
Figure 16A:
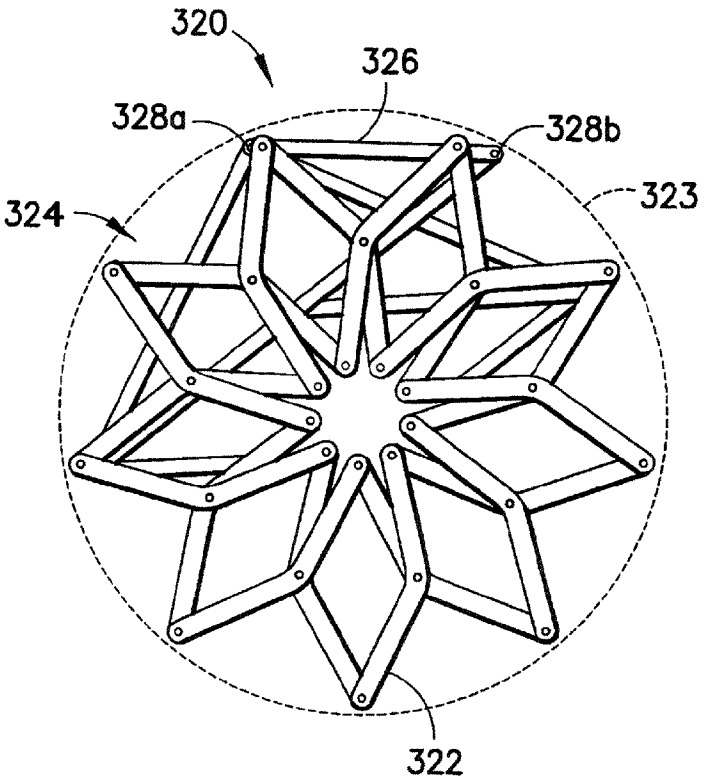

The baseline of the Peaucellier-Lipkin type actuatable linkage 304 is positioned external to the reversibly expandable structure 302 for applications in which an interior perimeter of the reversibly expandable structure 302 is used for applying a force. FIG. 16A and FIG. 16B respectively illustrate a planar diagram of an actuatable deployable structure system 320 including a reversibly expandable structure 322 coupled to an internal Peaucellier-Lipkin type actuatable linkage 324. The actuatable linkage 324 includes a fixed baseline 326 separating two pivot points 328*a*, 328*b*, and a pivotal linkage of seven rigid struts 330*a*, 330*b*, 330*c*, 330*d* (generally 330), 332*a*, 332*b* (generally 332) and 334 arranged similar to the external actuatable linkage 304. In some embodiments, the entire actuatable linkage 324 is contained with a perimeter 323 of the reversibly expandable device 322 in its collapsed state (FIG. 16A), in its expanded state (FIG. 16B), and any state in between. Consequently, the baseline 326 of the Peaucellier-Lipkin type actuatable linkage 324 is positioned internal to the reversibly expandable structure 322 for applications in which an exterior perimeter 323 of the reversibly expandable structure 322 is used for applying a force.

Figure 17A:
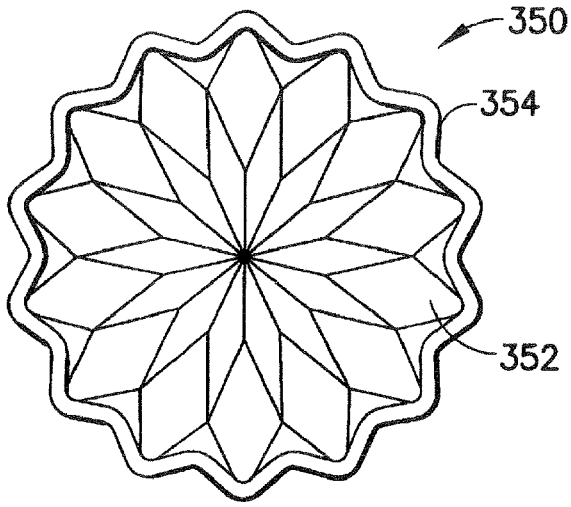
FIG. 17A and FIG. 17B respectively illustrate a planar view of an embodiment of a actuatable deployable structure system including a closed mechanical linkage of angulated elements having an external compliant layer according to the present invention in collapsed and expanded states.
Figure 17B:
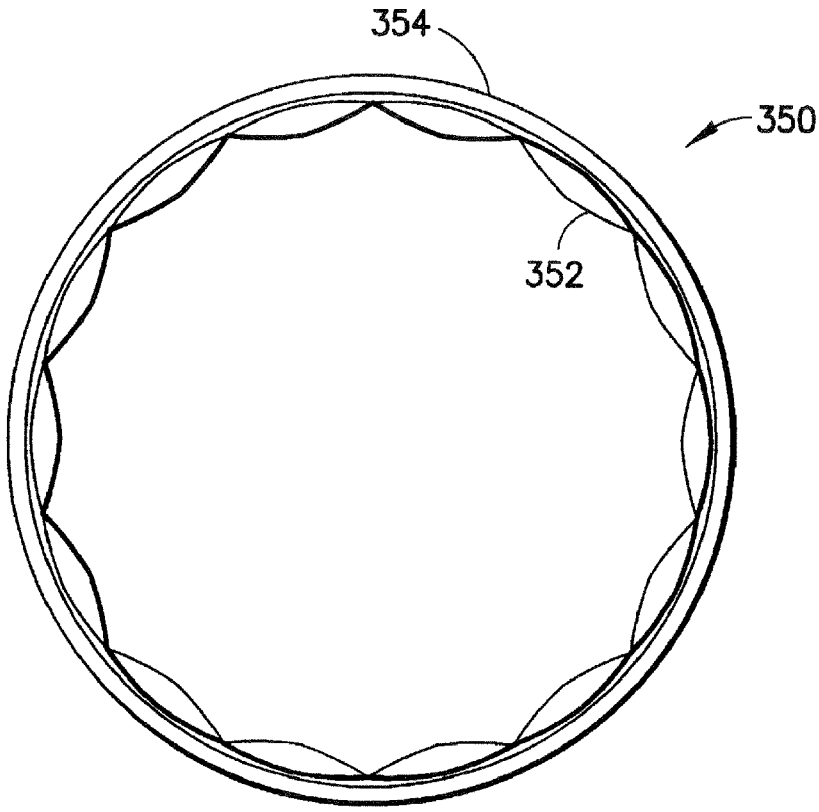

FIG. 17A and FIG. 17B respectively illustrate a planar view of another embodiment of a actuatable deployable structure system 350 including a closed mechanical linkage 352 of angulated elements having an external compliant layer 354. In some embodiments, the compliant layer 354 is provided as a sleeve configured to snugly engage a perimeter of a fully expanded mechanical linkage 352. As shown, the compliant layer 354 is positioned against an exterior perimeter of the reversibly expandable linkage 352. This configuration is particularly advantageous when the structure 350 transfers a force to another body using its external perimeter. The compliant layer can be used for protection as a buffer during operation. Alternatively or in addition, the compliant layer can be used to conform a perimeter of the structure 350 to an adjacent surface when deployed. For example, a compliant surface along an external perimeter can be used to conform to an inner perimeter of a cylindrical space in which the device 350 is deployed. Such a deployment may include sealing a portion of a well.

The compliant layer 354 or sleeve can be retained in this position by frictional engagement. Alternatively or in addition, the compliant layer 354 can be attached to the reversibly expandable linkage with mechanical fasteners, such as screws, clips, or staples, with chemical fasteners, such as adhesives, or bonding, or by a combination of two or more of these fasteners. In some embodiments, the compliant layer can be positioned against an interior perimeter of the reversibly expandable linkage. This is particularly advantageous when the structure 350 transfers a force to another body using its internal perimeter.

The compliant layer 354 can be a continuous layer that may be provided as a continuous sleeve of compliant material. The compliant layer can be a discontinuous layer that may be provided as segments against selected perimeter surfaces of one or more basic modules of the reversibly expandable structure 352. For example, the compliant layer can be formed using compliant pads attached to at least one of an interior and exterior perimeter surface of at least some of the basic modules of the reversibly expandable structure 352. When applied to all of the interior or all of the exterior surfaces of all of the basic structures of the reversibly expandable structure 352, a smooth continuous compliant layer can be obtained transformed in at least one of the collapsed or expanded states.

The compliant material can be formed from one or more polymers, rubbers, elastomers, or foams. In some embodiments the compliant layer 354 includes more than one layer of compliant material. For example, a binary layer device includes two adjacent compliant layers that can have the same or different compliant properties. In some embodiments, a first compliant layer is relatively dense providing a coarse fit, while a second layer is relatively less dense providing a fine layer. The fine layer can be positioned against one of the reversibly expandable structure or an external body, depending upon which surface requires a fine seal.

The deployable structure systems described herein can be used in a wide variety of applications, including drilling and well applications. At least some of these applications related to drilling and wells include conveying material outward in a radial direction into a casing or open hole formation. The systems can also be used as part of robotics module for tractoring or crawling inside cylindrical spaces, such as casings or open holes.

Figure 18:
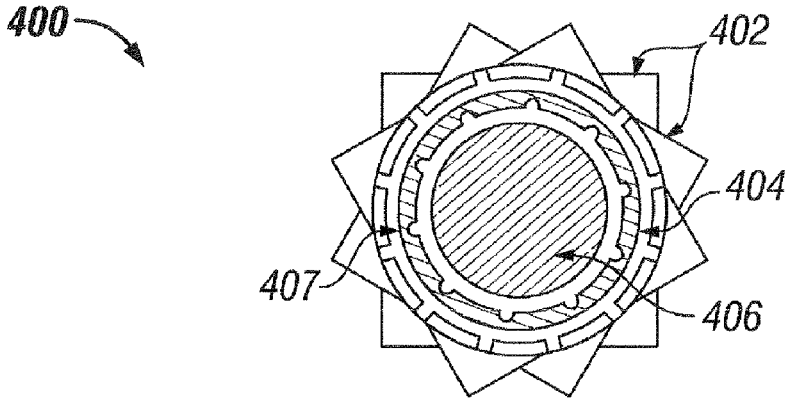
FIG. 18 is a partial cross-sectional end view of an embodiment of an apparatus in accordance with the present invention.
Figure 19:
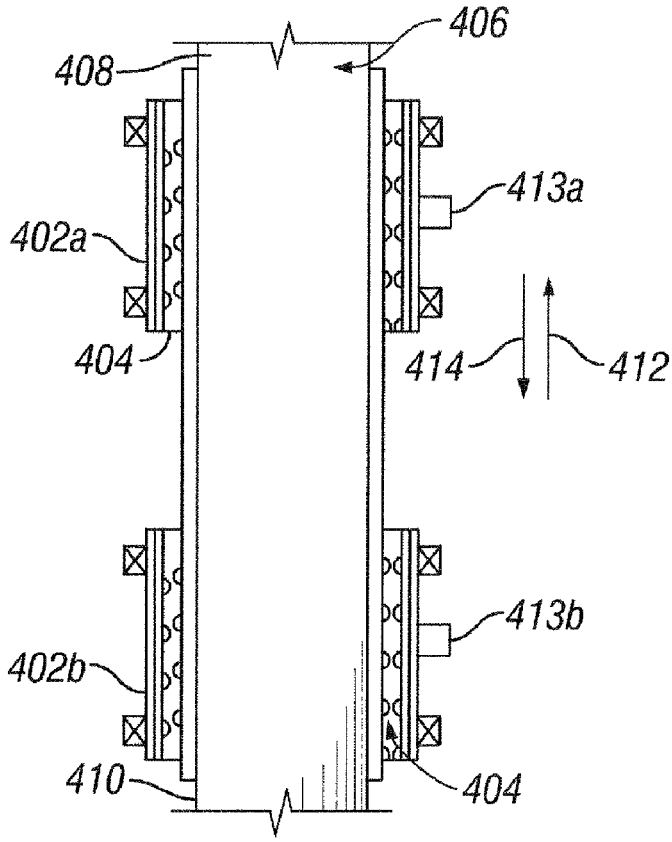
FIG. 19 is a partial cross-sectional plan view of the apparatus of FIG. 10.
Figure 20:
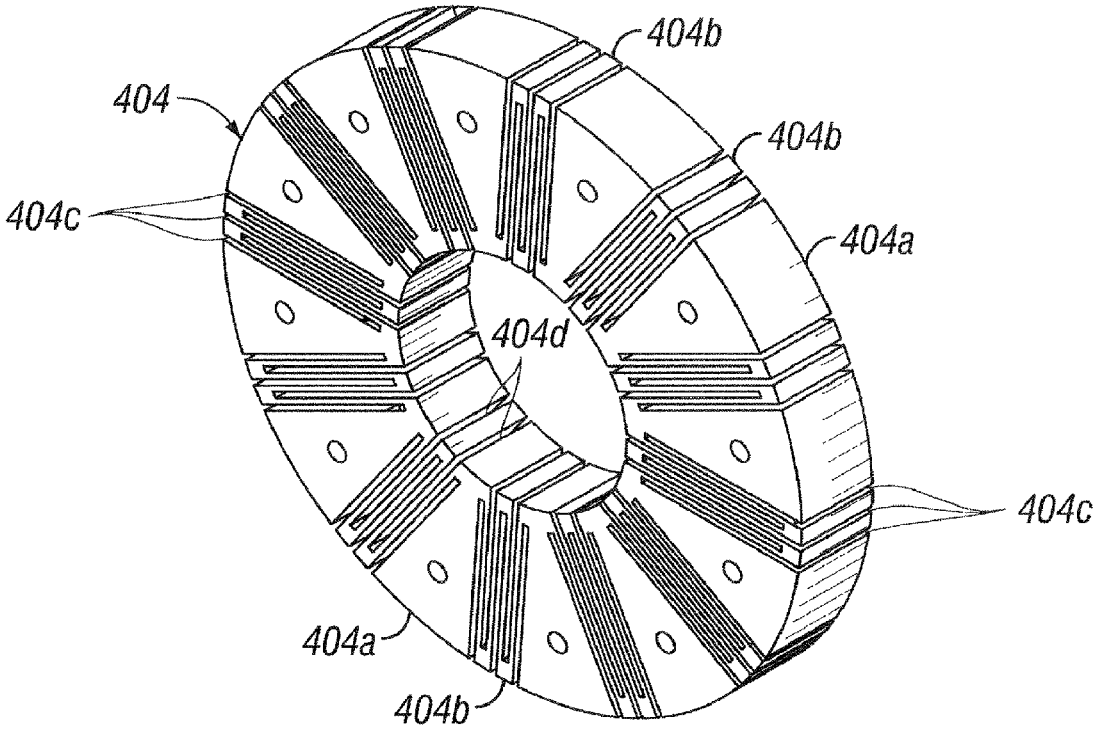
FIGS. 20 and 21 are perspective views, respectively of a embodiments of a compliant mechanism of the present invention.
Figure 21:
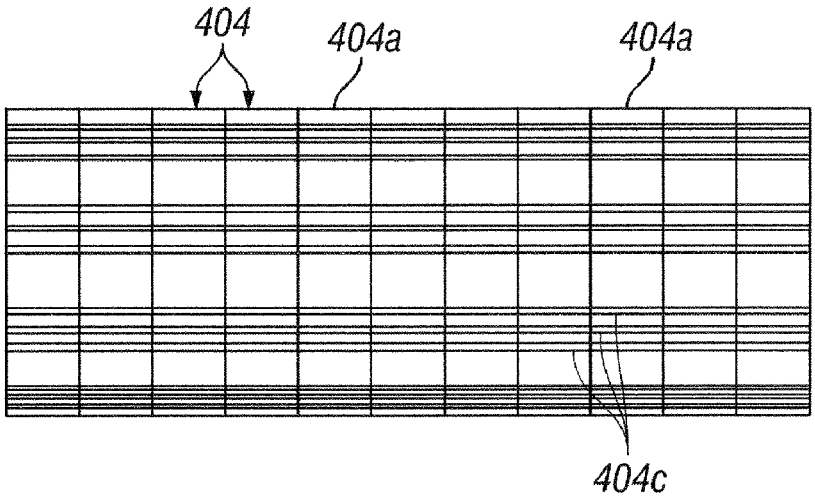

Referring now to FIG. 18-21, an embodiment of an apparatus of the present invention is indicated generally at 400. The apparatus 400 includes a closed loop deployable or reversibly expandable structure 402, such as, but not limited to, one of the reversibly expandable structures 122, 150, 170, 190, 220, 260, 280, 290, 203, 322 or 352, shown in FIG. 1-17, or the like. An actuator, such as, but not limited to, one of the actuators 124, 156/158, 176/178, 196/198, 201, 224/226, 250, 282, 292, 304, and 324 shown in FIG. 1-17, is operable to move the reversibly expandable structure 402 between a maximum and minimum perimeter dimension, as recited above. A compliant mechanism 404, such as the compliant mechanism or ring disclosed in commonly assigned and copending Ser. No. 11/273,758 filed on Nov. 15, 2005, which is incorporated herein by reference in its entirety, is disposed interior of the reversibly expandable structure 402. The compliant mechanism 404 is preferably formed from one or more polymers, rubbers, elastomers, or foams, or a suitable polymeric or plastic material. Alternatively, the compliant mechanism 404 is formed from materials having similar material properties. There is shown in FIGS. 20 and 21 a non-limiting embodiment of a compliant mechanism as a compliant ring 404 (FIG. 21) and a plurality of compliant rings 404 (FIG. 20) having a substantially circular cross section and adapted to radially expand from a substantially relaxed position to an expanded position. The compliant rings 404 each include a plurality (e.g., twelve) of generally triangular- or wedge-shaped structural segments, each indicated at 404*a*, that are circumferentially arranged about the longitudinal axis of the mechanism 404. Each structural segment 404*a* is attached to its adjacent structural segment 404*a* by interconnecting portions, each indicated at 404*b*. As shown, the compliant ring has a series of slits or notches 404*c*, 404*d* extending inwardly from its outer diameter (slits 404*c*) and extending outwardly from the inner diameter (slits 404*d*) that together define the structural segments 404*a* and the interconnecting portions 404*b*.

An instrument 406 is disposed interior of the compliant mechanism 404. The instrument 406 may be, but is not limited to, any number of oilfield devices such as logging tools, downhole equipment, surface equipment, and the like. Although shown as cylindrical and having a generally circular cross section, those skilled in the art will appreciate that the instrument 406 may have any cross section or shape while remaining within the scope of the present invention. Alternatively, the instruments 406 that can be deployed by the apparatus 400 have shapes including, but not limited to, prismatic, cylindrical (right cylinder or inclined cylinder), conical (right cone or inclined cone) or truncated pyramidal, as will be appreciated by those skilled in the art.

Those skilled in the art will appreciate that a plurality of reversibly expandable structures 402, such as a plurality of reversibly expandable structures 402 arranged in an array along, for example, an axial length of the instrument 406, may be attached to an instrument 406 while remaining within the scope of the present invention. As seen in FIG. 19, a first reversibly expandable structure 402*a* is attached to a first end 408 of the instrument 406 and a second reversibly expandable structure 402*b* is attached to a second end 410 of the an instrument 406.

When a plurality of reversibly expandable structures 402 are arranged in series, such as those structures 402*a* and 402*b* shown in FIG. 19, the reversibly expandable structures 402*a* and 402*b* can be used to deploy instruments 406 in an inchworm manner in an axial direction of the instrument 406, indicated by an arrow 412. The reversibly expandable structures 402*a* and 402*b* are operable to grab the instrument 406 when the actuator moves the reversibly expandable structures 402*a* and 402*b* to engage with the outer diameter of the instrument 406. The reversibly expandable structures 402*a* and 402*b* are advantageously able to conform to different outside diameters of various instruments 406, as noted above. The reversibly expandable structures 402*a* and 402*b* are also able to move in the directions indicated by the arrows 412 and 414 by linear actuators, indicated schematically at 413*a* and 413*b*, such as the linear actuator 201 shown in FIGS. 8A and 8B, as will be appreciated by those skilled in the art. The linear actuators 413*a* and 413*b* may be driven by any suitable power source including, but not limited to, electrical, hydraulic, pneumatic, and the like. The linear actuators 413*a* and 413*b* are preferably coaxially located with the deployable structures 402*a* and 402*b* such that the linear actuators do not extend beyond the outer radial dimensions of either the reversibly expandable structures 402*a* and 402*b*. The linear actuators 413*a* and 413*b* preferably engage with a wall of the wellbore (not shown) or the like as well as with the outer diameter of either the instrument 406, the reversibly expandable structures 402*a* and 402*b*, or both.

In a first step, the reversibly expandable structure 402*a* grabs the instrument 406 and the linear actuator 413*a* moves the instrument 406 in the direction 412 while the linear actuator 413*b* moves the reversibly expandable structure 402*b* axially in the opposite direction 414 without grabbing the instrument 406. In a second step, the reversibly expandable structure 402*a* stops conveying, but holds the instrument 406 while reversibly expandable structure 402*b* grabs the instrument 406. In a third step, the reversibly expandable structure 402*a* disengages from the instrument 406 and the reversibly expandable structure 402*b* conveys the instrument in the axial direction 412 in which it has to be conveyed while the reversibly expandable structure 402*a* moves axially in the opposite direction 414.

The compliant structures 404 advantageously provide a smooth engagement between the inner surfaces of the reversibly expandable structures 402*a* and 402*b* and the outer surface or diameter of the instrument 406. Alternatively, the reversibly expandable structures 402*a* and 402*b* perform the inchworm conveyance without the use of compliant mechanisms 404.

Alternatively, locomotion is produced for an instrument, such as an instrument 406, using both thin film fluid mechanics, and/or actuation of a flexible membrane that has a wave shape deformation. Gastropods move in this manner by a wave shaped flexible membrane (the gastropod foot) that compresses a thin fluid film and the reaction forces due to the pressures acting on the gastropod foot propel it in the direction opposite to the wave motion.

The tractoring force Ft (that produces the thin fluid film locomotion) is determined by Equation 1 below, where Ft is the tractoring force (in Newtons or N), Mu is Fluid viscosity (in Pascal seconds or Pa·s), Vw is waving speed (in meters per second or m/s), Ac is contact area (in square meters or $m^2$), and h is the gap thickness (in meters or m).

$$Ft=Ft(mu, Vw, Ac, h, \text{[wave shape]}) \qquad \text{Equation 1}$$

By applying the theory for thin film locomotion in two dimensions, assuming that there is no side leakage, and estimating the maximum tractoring force when the system is not moving, Equation 2 is obtained to predict the tractoring force.

$$Ft=mu*Vw*Ac*(1/h)*f(\text{wave shape}) \qquad \text{Equation 2}$$

Equation 2 shows that the tractoring force changes when the wave shape changes. For a sinusoidal wave, the wave shape changes by changing a/h, or the amplitude of the wave with respect to the average height of the wave. The ratio a/h varies between 0 and 1. The model in equation 2 shows for a/h=0.95, f=85, which means theoretically, if mu=1 Pa·s, Vw=0.1 m/s, Ac=1 m2, h=0.01 m, a=0.0095 m, Ft=850N. By keeping all variables the same, we would just have to increase Vw by 17% to get Ft=1000N at Vw=0.117 m/s. Table 2 shows values of f for different values of a/h, which shows the desirability of having the value of a/h very close to 1. However, it must be emphasized that it is important to keep control of the value of a/h with high precision.

TABLE 1

| a/h | f |
|---|---|
| 0.5 | 1.1 |
| 0.75 | 5.4 |
| 0.8 | 8.2 |
| 0.9 | 27 |
| 0.95 | 85 |
| 0.99 | 1300 |

The thrust or tractoring force can be exerted by the inchworm manner combining deployable or reversibly expandable structures and compliant mechanisms, such as the reversibly expandable structures 402 and the compliant mechanisms 404 as recited above and shown in FIG. 18-21. Alternatively, the thrust can be exerted by using thin film fluid mechanics and at least direct waves, discussed in more detail below.

Figure 22:
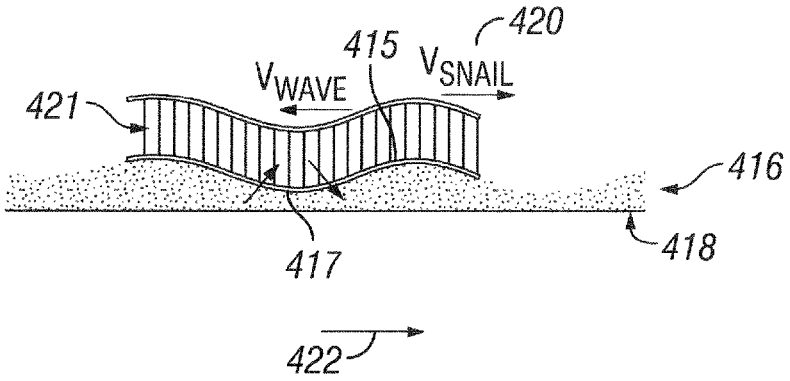
FIG. 22 is a schematic view of an embodiment of an apparatus of the present invention.

Referring to the schematic system of FIG. 22, thin film locomotion can be achieved by generating a wave 415 in a fluid 416 (referred to hereinafter as a tractoring fluid), such as by deforming a deformable or flexible body 421 and compressing the fluid 416 between the body 421 and the ground 418, with respect to which the locomotion of the body 421 takes place (the fluid 416 also moves with respect to the ground 418). The bottom of the body 421 moves in a direction indicated by an arrow 420 with respect to the ground 418, best seen schematically in FIG. 22. At a low point 417 in the wave 415, the tractoring fluid 416 is squeezed into a narrow gap, creating a region of high pressure to the left of the wave point 417. Conversely, at the back of the wave point 417, tractoring fluid 416 flows unobstructed into a widening gap, resulting in a decrease in pressure. These two pressures, acting normal to the interface between the body 421 and the tractoring fluid 416, result in a net tractoring force opposite to the direction of wave propagation, indicated by an arrow 422.

Such tractoring forces and mechanisms for generating the wave shape of deformable bodies, such as the body 421, are shown and described in commonly assigned and co-pending application Ser. No. 11/247,918, which is herein incorporated by reference in its entirety. Such mechanisms include generating the wave shape in a foot by a helix shaped mechanism (driven by an electric motor or the like), which actuates a plurality of plates that are constrained to move in the direction normal to the foot due to slots on the system's frame.

Figure 23:
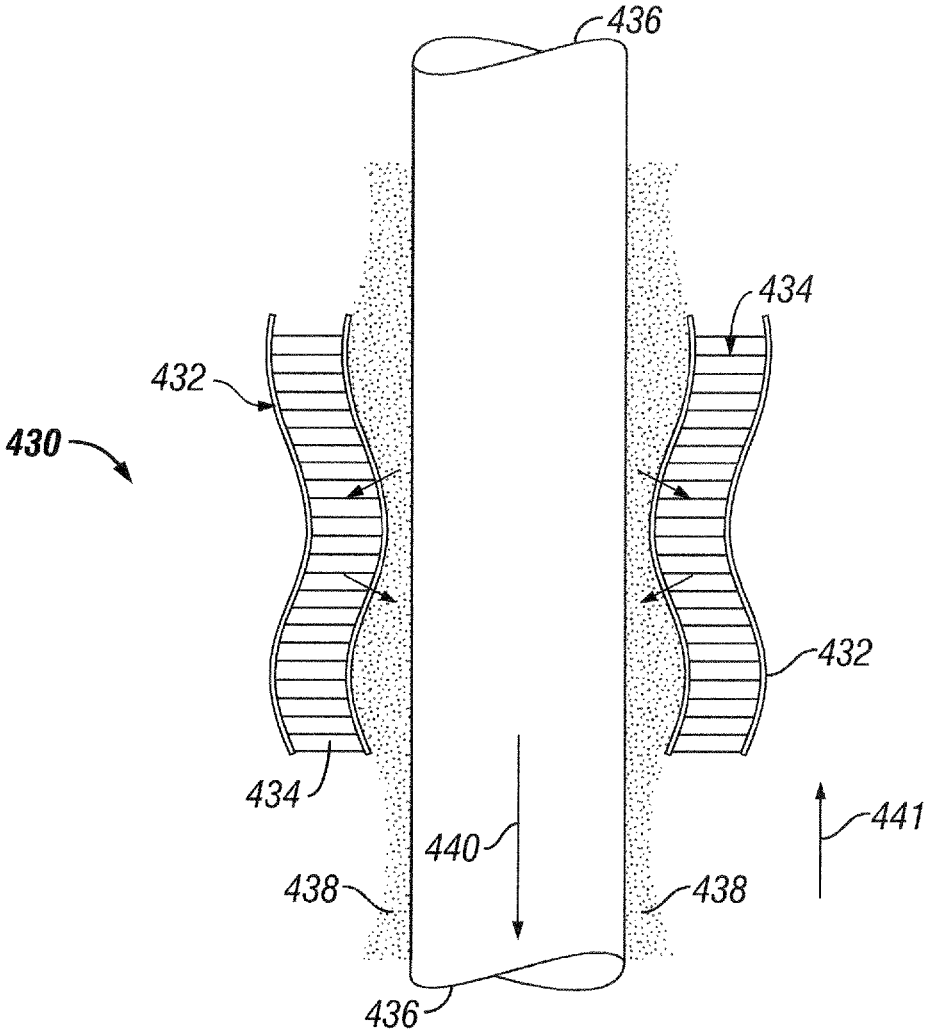
FIG. 23 is a schematic view of an embodiment of an apparatus of the present invention.

Referring now to FIG. 23, an embodiment of an apparatus in accordance with the present invention is indicated generally at 430. The apparatus includes at least one and preferably a plurality of closed loop deployable or reversibly expandable structures 432, such as, but not limited to, one of the reversibly expandable structures 122, 150, 170, 190, 220, 260, 280, 290, 203, 322 or 352, shown in FIG. 1-17, the reversibly expandable structure 402 shown in FIG. 18-21, or the like. An actuator, such as, but not limited to, one of the actuators 124, 156/158, 176/178, 196/198, 201, 224/226, 250, 282, 292, 304, and 324 shown in FIG. 1-17, is operable to move the reversibly expandable structure or structures 432 between a maximum and minimum perimeter dimension, as recited above. A compliant mechanism 434, similar to the compliant mechanism 404 shown in FIG. 18-21 or the like, is disposed interior of the reversibly expandable structure 432.

An instrument 436, such as the instrument 406 shown in FIG. 18-21 or the like, is disposed interior of the compliant mechanism 434. The instrument 436 may be, but is not limited to, any number of oilfield instruments or devices such as logging tools or similar downhole equipment, surface equipment (such as, but not limited to, a coiled tubing injector, a blow out preventer (BOP), a slip ram, a shear ram and a stripper), downhole tools (such as, but not limited to, a patch, a plug, an actuator, and a tractor), and completion equipment, (such as, but not limited to, a sliding sleeve), as will be appreciated by those skilled in the art.

Although shown as cylindrical and having a generally circular cross section, those skilled in the art will appreciate that the instrument 436 may have any cross section or shape while remaining within the scope of the present invention. Alternatively, the instruments 436 that can be deployed or otherwise engaged by the apparatus 430 have shapes including, but not limited to, prismatic, cylindrical (right cylinder or inclined cylinder), conical (right cone or inclined cone) or truncated pyramidal, as will be appreciated by those skilled in the art.

A preferably non-Newtonian tractoring fluid 438 (such as, but not limited to, mud or emulsions or the like, i.e. a fluid whose viscosity changes with an applied strain rate) is disposed between the instrument 436 and the compliant mechanism 434. The tractoring fluid 438 may be, but is not limited to, wellbore fluids including drilling mud, or the like. When an actuator, such as, but not limited to, one of the actuators 124, 156/158, 176/178, 196/198, 201, 224/226, 250, 282, 292, 304, and 324 shown in FIG. 1-17, or the like, moves the reversibly expandable structure or structures 432, this produces a wave, such as the wave 415 shown in FIG. 22, in the tractoring fluid 438 and moves the instrument 436 in the direction 440, in the manner as recited above. The wave may be a direct wave (wherein the wave produced propagates in the same direction 440 as the movement of the instrument 436) or a retrograde wave (wherein the wave produced propagates in an opposite direction, indicated by an arrow 441, to the movement of the instrument 436), as will be appreciated by those skilled in the art. The compliant mechanism 434 allows the system to conform to the changing perimeter of the instrument 436 being conveyed. The compliant mechanism 434 also advantageously maximizes the contact area with the tractoring fluid 438.

Figure 24:
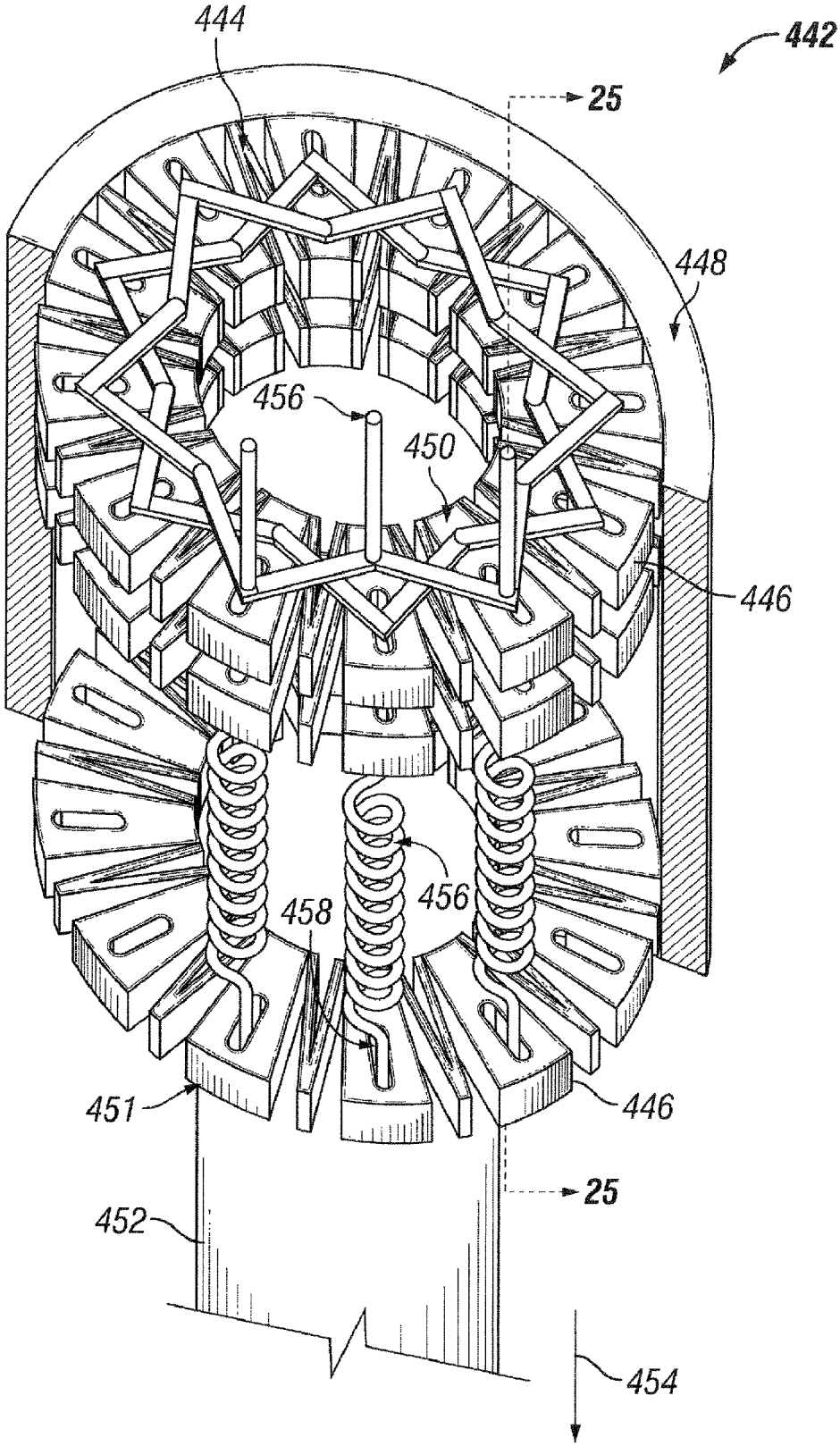
FIG. 24 is a partial cross-sectional perspective view of an embodiment of an apparatus of the present invention.

Referring now to FIG. 24, an embodiment of an apparatus in accordance with the present invention is indicated generally at 442. The apparatus 442 includes at least one reversibly expandable structure 444, similar to the reversibly expandable structures 122, 150, 170, 190, 220, 260, 280, 290, 203, 322 or 352, shown in FIG. 1-17, and 402, disposed adjacent at least one compliant mechanism 446, similar to the compliant mechanisms 404 and 134. The reversibly expandable structure 444 and compliant mechanism 446 are disposed within an enclosure 448, such as a cylindrical enclosure or the like. Those skilled in the art will appreciate the enclosure 448 may be formed in many shapes while remaining within the scope of the present invention. The apparatus 442 includes an actuator, indicated schematically at 450, such as, but not limited to, one of the actuators 124, 156/158, 176/178, 196/198, 201, 224/226, 250, 282, 292, 304, and 324 shown in FIG. 1-17, for moving the reversibly expandable structure 444 between a maximum and minimum perimeter dimension. A preferably thin layer of a non-Newtonian tractoring fluid, indicated generally at 451, is disposed between the compliant mechanism 146 and an instrument, indicated generally at 452.

The reversibly expandable structure 444, when alternately moved by the actuator 450 between a maximum perimeter dimension and a minimum perimeter dimension, generates a wave in the tractoring fluid 451 and moves the instrument 452 in a direction indicated by an arrow 454. The reversibly expandable structure 444 and compliant mechanism 446 are constrained from movement by the enclosure 448. By virtue of this constraint, the wave generated in the tractoring fluid 451 and its resultant generated tractoring force does not move the reversibly expandable structure 444 and compliant mechanism 446 (as shown in FIG. 22) but rather moves the instrument 452 disposed adjacent the reversibly expandable structure 444 and compliant mechanism 446.

Alternatively, or in addition to the actuator 450, an actuator 456 is provided having a helix shaped mechanism 458, similar to the helix shaped mechanism shown in commonly assigned and co-pending application Ser. No. 11/247,918 (incorporated by reference in its entirety as noted above) that actuates hydraulic cylinders 460 (best seen in FIGS. 25 and 26) arranged axially along the instrument 452. The cylinders 460 are preferably each operated in series to generate a wave in the tractoring fluid 451 and thereby produce a tractoring force in the tractoring liquid 451 to convey the instrument 452 in the direction 454.

Figure 25:
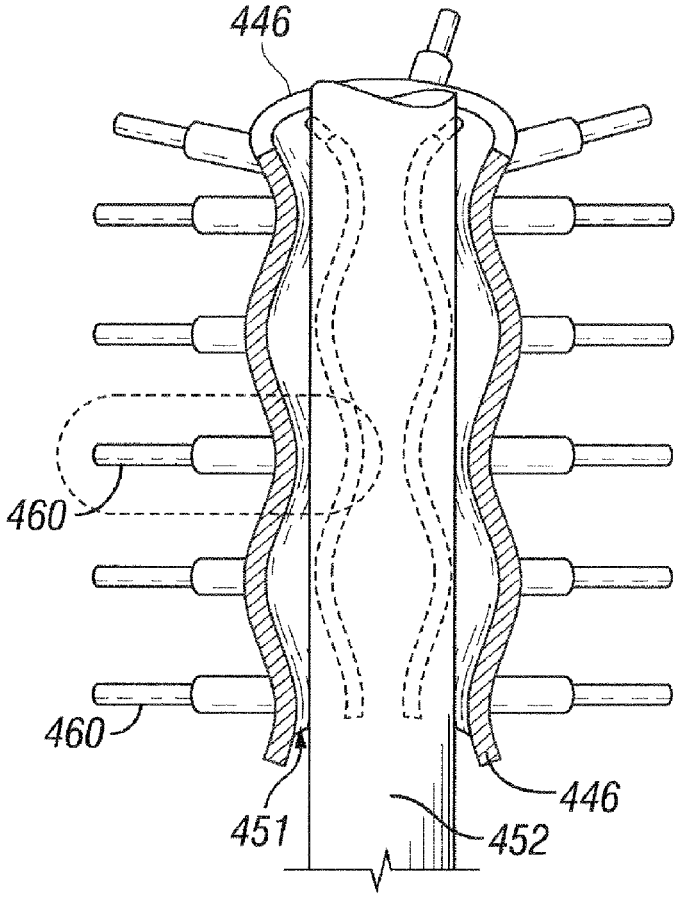
FIG. 25 is a partial cross-sectional perspective view of the apparatus of FIG. 24.
Figure 26:
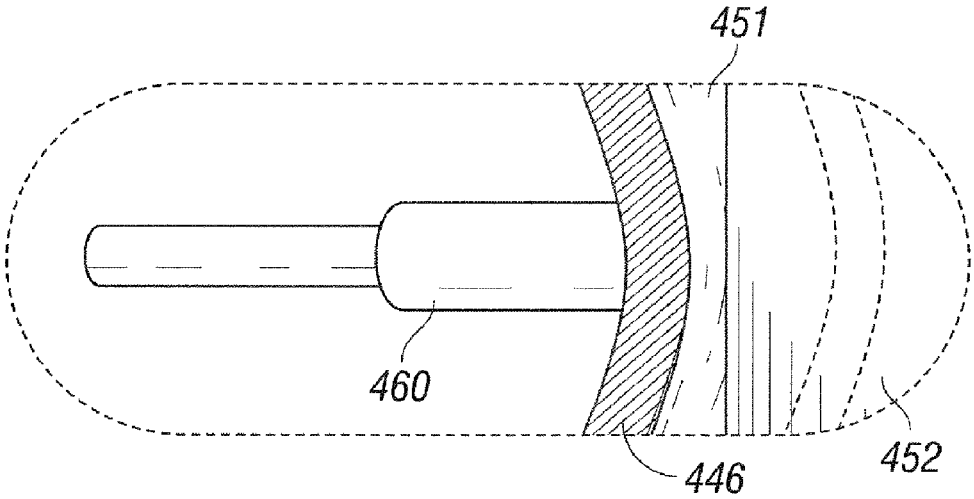
FIG. 26 is a schematic view of an actuator for an embodiment of the apparatus of FIG. 25.
Figure 27:
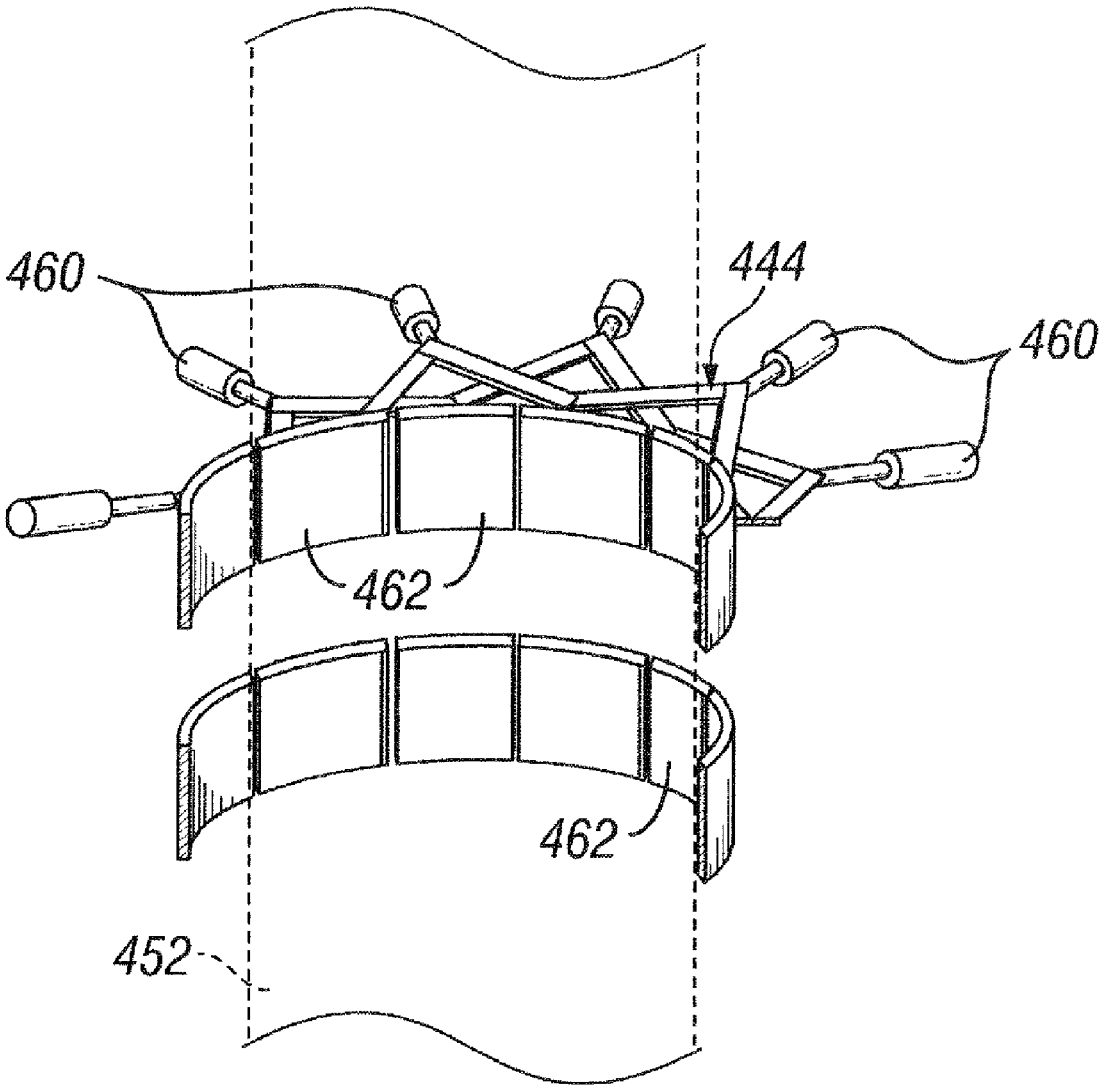
FIG. 27 is a partial cross-sectional perspective view of an apparatus of the present invention.

Referring now to FIG. 27, alternatively, the reversibly expandable structure 444, when moved between positions, may be acted upon or actuated by a plurality of pistons, such as the pistons 460 shown in FIGS. 25 and 26. This actuation allows a plurality of pads 462 disposed interior of the reversibly expandable structure 444 to adjust to the changing diameter of the conveyed instrument 452 to be conveyed. The instrument 452, therefore, can have a variable diameter along its whole length.

Figure 28:
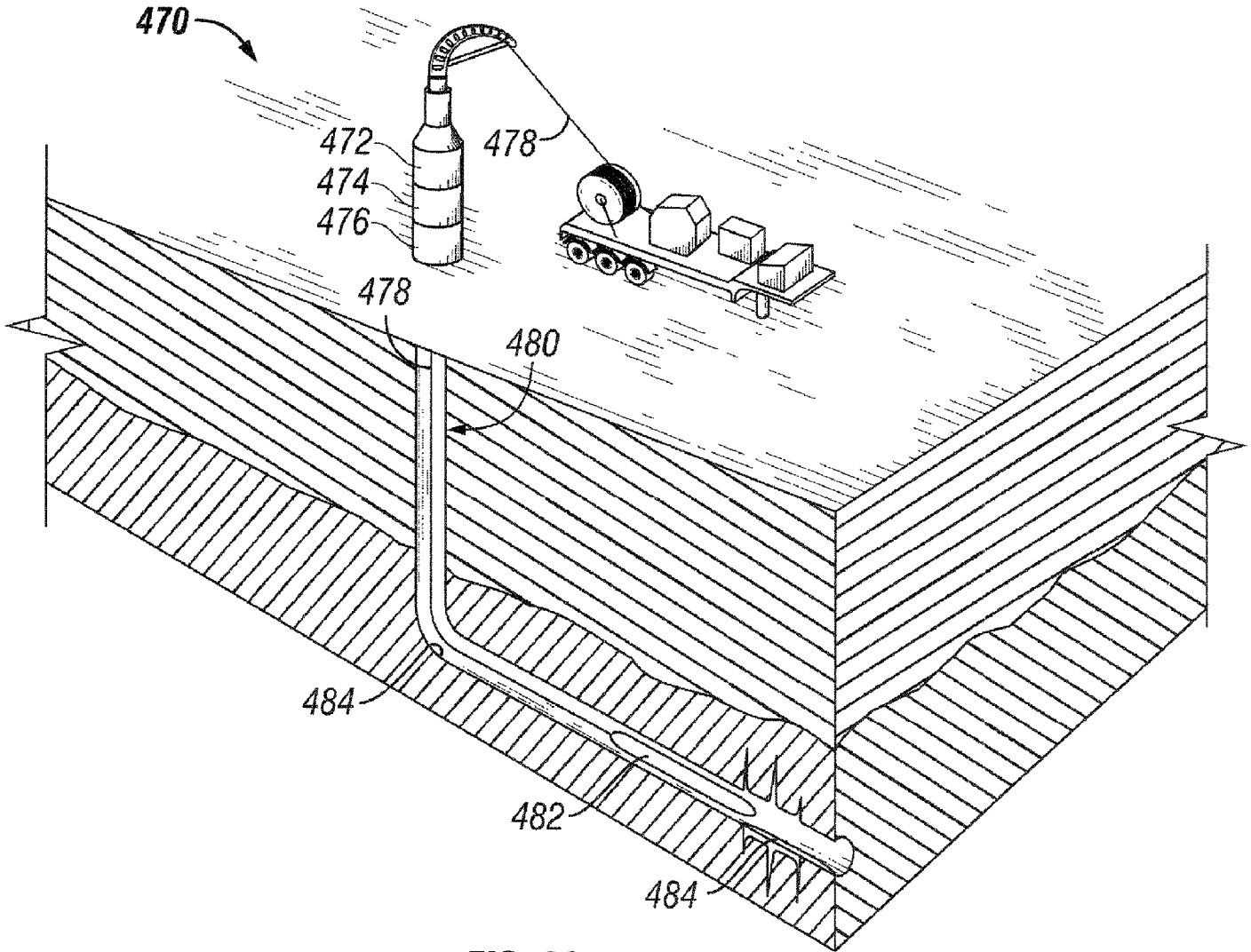
FIG. 28 is a partial cross-sectional perspective view of an embodiment of the present invention shown with wellsite equipment and a wellbore.

Referring now to FIG. 28, a typical wellsite equipment arrangement is shown schematically at 470. Those skilled in the art will appreciate that the apparatus 400 or 442 may be utilized with any number of wellsite or wellbore equipment including, but not limited to, logging tools 482 or similar downhole equipment, surface equipment, indicated schematically at 472, 474, and 476 (such as, but not limited to, a coiled tubing injector, a blow out preventer, a slip ram, a shear ram and a stripper, other downhole tools 482 (such as, but not limited to, a patch, a plug, an actuator, and a tractor), and completion equipment 482, (such as, but not limited to, a sliding sleeve or the like). As will be appreciated by those skilled in the art, when utilized with downhole tools or equipment 482, the apparatus 400 or 442 may engage with an interior surface, casing, or tubing 484 of the wellbore 480 or the like and an exterior surface of the downhole tool or equipment 482. When utilized with surface equipment 472, 474, or 476, the apparatus 400 or 442 may engage with an interior surface of the equipment 472, 474, or 476 and an exterior surface of an instrument or a tubular 478, such as coiled tubing, jointed pipe, wireline, or the like. When utilized with completion equipment, the apparatus 400 or 442 may engage with an interior surface 484 of the wellbore 480 and an exterior surface of the completion equipment 482.

Figure 29:
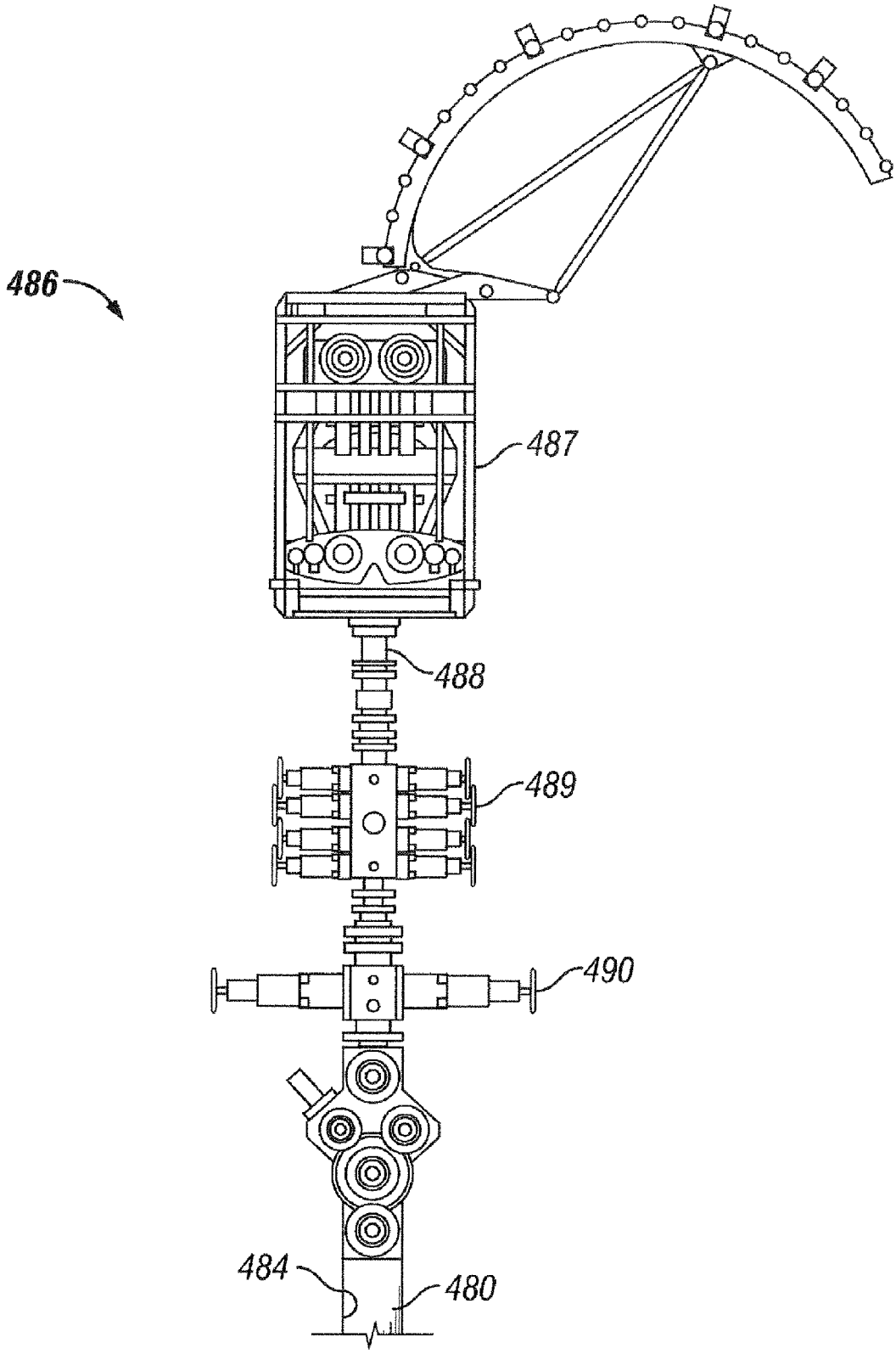
FIG. 29 is a schematic perspective view of wellsite equipment and a wellbore usable with embodiments of the present invention.

Referring now to FIG. 29, a typical wellsite surface pressure control equipment arrangement or system for a wellbore is shown schematically at 486. Those skilled in the art will readily appreciate that an apparatus 400, 430 and 442, that includes a reversibly expandable structure such as, but not limited to, one of the reversibly expandable structures 122, 150, 170, 190, 220, 260, 280, 290, 203, 322 or 352, shown in FIG. 1-17, or the like, may be advantageously utilized with many of the typical surface control equipment found at a wellsite. The apparatus 400, 430, or 442 may be utilized to convey a tubular, such as coiled tubing or the like, in an injector 487 either through thin fluid film locomotion or through inch-worm motion, as recited above, by engaging, for example, with an outer surface of the tubular and a housing for the injector 487 or the like. Similarly, the apparatus 400, 430, or 442 may be utilized as a prime mover in providing sealing pressure to a stripper 488. Similarly, the apparatus 400, 430 or 442 may be utilized to provide an actuator to allow an interior surface of a blow out preventer(s) 489 or a shear-seal blow out preventer 490 (and other similar wellsite pressure control equipment), to engage with (for example, sealing, gripping, cutting, or the like) an exterior surface of the tubular or with itself (in the case of a blow out preventer), as will be readily appreciated by those skilled in the art.

The pressure inside a wellbore, such as the wellbore 480 shown in FIG. 28, where the instrument 406, 436, and 452 is deployed, can be higher than the outside pressure from which the instrument 406, 436, and 452 is conveyed. Alternatively, the apparatus 400, 430, or 442 may be utilized to pressure compensate the environment surrounding the instrument 406, 436, and 452, that is being deployed into the wellbore 480.

In the system or apparatus 430 and 442, the tractoring fluid 438 and 451 is used to pressure compensate the environment (provide a compensating pressure) surrounding the instrument 436 and 452. The tractoring fluid 438 or 451 in the radial gap between the outer diameter of the instrument 436 or 452 and the inner diameter of the reversibly expandable structure 402 or 444 is not affected by the pressure in the surrounding fluid outside the radial gap. In addition, the tractoring fluid 438 or 451 used for conveyance is also utilized for sealing in a manner similar to lubricators utilized for inserting wireline tools into a wellbore or the like.

Sealing around the instruments 406 can be achieved using deployable structures, such as the apparatus 400 in FIG. 18 but further comprising sealing material (shown schematically at 407 in FIG. 18) disposed between the outer surface of the deployed tool or instrument 406 and the inner surface of the reversibly expandable structure 402.

The apparatus or system 400 or 442 has the capabilities to exert thrust in order to convey instruments 406, 436, and 452 in their longitudinal axis, seal at least a portion of the instrument 406, 436, and 452 from the elements contained in the environment from which they are being conveyed, and pressure compensate (i.e. create a pressure compensating volume around at least a portion of the instrument 406, 436, and 452 in order to counteract the differential pressure between the environment from where the 406, 436, and 452 are being deployed and the well pressure) during their conveyance. The apparatus or system 400 or 442 is operable to provide all these capabilities or a system may include a plurality of the apparatuses or systems 400 or 442 addressing each capability separately.

The apparatus or system 400 or 442 can be used for multiple purposes in not only the oil business and/or wellsite or wellbore equipment, but also other areas including, but not limited to, conveying instruments, with the geometric characteristics mentioned above, in an axial direction into a well or inside a well, as will be appreciated by those skilled in the art. The cross-sectional profiles of the cylindrical instrument can have any shape that varies along its longitudinal axis (Z direction). The apparatus or system 400 or 442 may also be utilized for conveying parts inside cylindrical enclosures during an assembly process or the like.

The apparatus or system 400 or 442 in accordance with embodiments of the present invention advantageously combines a mechanical system (the reversibly expandable structure 402 or 444) that utilizes thin film fluid mechanics in non newtonian fluids 438 and 451. The apparatus or system 400 or 442 of embodiments of the present invention can deploy instruments 406, 436, and 452 into a well continuously without having to connect them to each other before deployment, has a variable and adjustable inner and outer perimeter. In conjunction with a module that uses thin film fluid mechanics with either retrograde waves or direct waves, the apparatus or system 400 or 442 can produce thrust and sealing simultaneously. Alternatively, the system and apparatus 400 or 442 comprises different modules that separately produce thrust and sealing in the different modules.

The apparatus or system 400 or 442 adjusts its perimeter to the perimeter of the space where it deploys and/or conforms to the outer perimeter of the instrument 406, 436, or 452 it deploys. The apparatus or system 400 or 442 has variable and adjustable expansion ratio, defined by the mathematical relationship between the expanded position and the collapsed position of the reversibly expandable structures 402 or 444. The cross sectional perimeter of the instrument 406, 436, and 452 being deployed is not restricted to circular shapes, it can have any shape. The apparatus or system 400 or 442 can be locked and unlocked as desired at different states (such as by utilizing lock 114 or lock 180, as noted above), can be stacked in series along its axial direction (Z direction) with other similar or identical apparatuses or systems 400 or 442, in order to form longer systems with either higher thrust or sealing capability.

The apparatus or system 400 or 442 may further comprise other types of mechanisms, such as compliant mechanisms 404, 434, or 446, to form hybrid systems that have kinematics characteristics of classical mechanism, and elasto-mechanical characteristics of compliant mechanisms. The apparatus or system 400 or 442 can be actuated in different ways such as an electromechanical system or an electro hydraulic system, and has significant stiffness and strength in its expanded state to hold compliant members, such as compliant mechanisms 404, 434, or 446, as needed.

The preceding description has been presented with reference to presently preferred embodiments of the invention. Persons skilled in the art and technology to which this invention pertains will appreciate that alterations and changes in the described structures and methods of operation can be practiced without meaningfully departing from the principle, and scope of this invention. Accordingly, the foregoing description should not be read as pertaining only to the precise structures described and shown in the accompanying drawings, but rather should be read as consistent with and as support for the following claims, which are to have their fullest and fairest scope.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

We claim:

1. An apparatus for deploying an instrument usable with a well, comprising:

at least one reversibly expandable structure;

at least one actuator operable to change a perimeter dimension of the at least one reversibly expandable structure;

at least one instrument disposed interior of the at least one reversibly expandable structure, and having an axial dimension; and tractoring fluid disposed between the at least one reversibly expandable structure and the at least one instrument, the apparatus operable to perform at least one of exerting thrust to convey the at least one instrument with respect to at least one adjacent surface, creating compensating pressure between the at least one instrument and the at least one adjacent surface, and sealing between the at least one instrument and the at least one adjacent surface;

wherein the apparatus further comprises at least one compliant mechanism attached to an interior perimeter of the at least one reversibly expandable structure.

2. The apparatus of claim 1 wherein the perimeter dimension of the at least one reversibly expandable structure is variable, lockable, and adjustable.

3. The apparatus of claim 1 wherein the at least one reversibly expandable structure has a predetermined maximum and minimum perimeter dimension defined by an expansion ratio.

4. The apparatus of claim 3 wherein the at least one actuator is operable to move the at least one reversibly expandable structure between the maximum and minimum perimeter dimensions.

5. The apparatus of claim 1 wherein the at least one actuator comprises a one of a linear actuator, a rotary actuator, a rotatable disk actuator, a lever actuator, and a Peaucellier-Lipkin type actuatable linkage.

6. The apparatus of claim 1 wherein the at least one compliant mechanism is disposed between the at least one reversibly expandable structure and the at least one instrument.

7. The apparatus of claim 1 wherein the compliant mechanism comprises at least one compliant ring.

8. The apparatus of claim 1 wherein the at least one reversibly expandable structure is operable to engage with instruments and adjacent surfaces having a range of dimensions.

9. The apparatus of claim 1 wherein the at least one adjacent surface is a wellsite equipment surface.

10. The apparatus of claim 1 wherein the at least one adjacent surface is a surface in a wellbore.

11. The apparatus of claim 10 wherein the instrument comprises a one of patch, a plug, an actuator, a tractor, and a logging tool.

12. The apparatus of claim 10 wherein the instrument comprises a sliding sleeve.

13. The apparatus according to claim 1 wherein the apparatus produces thrust in the instrument by propagating a one of retrograde film wave motion and direct wave film motion in the tractoring fluid.

14. The apparatus of claim 1 wherein the at least one reversibly expandable structure comprises at least a pair of reversibly expandable structures connected in series along an axial dimension of the at least one instrument.

15. The apparatus of claim 14 wherein each of the reversibly expandable structures performs one of exerting thrust to convey the at least one instrument with respect to at least one adjacent surface, creating pressure between the at least one instrument and at least one adjacent surface, and sealing between the at least one instrument and at least one adjacent surface.

16. A method of conveying an instrument at a wellsite, comprising the steps of:

providing an apparatus comprising at least one reversibly expandable structure, at least one actuator operable to change a perimeter dimension of the at least one reversibly expandable structure, at least one instrument disposed interior of the at least one reversibly expandable structure, and having an axial dimension, and tractoring fluid disposed between the at least one reversibly expandable structure and the at least one instrument;

operating the actuator to change the perimeter dimension of the at least one reversibly expandable structure; and performing an operation on the at least one instrument with respect to at least one adjacent surface at the wellsite, wherein performing comprising the apparatus producing thrust in the instrument by propagating a one of retrograde film wave motion and direct wave film motion in the tractoring fluid.

17. The method of claim 16 wherein the perimeter dimension of the at least one reversibly expandable structure is variable, lockable, and adjustable.

18. The method of claim 16 wherein the at least one reversibly expandable structure has a predetermined maximum and minimum perimeter dimension defined by an expansion ratio and wherein the at least one actuator is operable to move the at least one reversibly expandable structure between the maximum and minimum perimeter dimensions.

19. The method of claim 16 wherein the at least one actuator comprises a one of a linear actuator, a rotary actuator, a rotatable disk actuator, a lever actuator, and a Peaucellier-Lipkin type actuatable linkage.

20. The method of claim 16 further comprising providing at least one compliant mechanism and disposing the at least one compliant mechanism between the at least one reversibly expandable structure and the at least one instrument.

21. The method of claim 20 wherein the compliant mechanism comprises at least one compliant ring.

22. The method of claim 16 wherein the at least one reversibly expandable structure is operable to engage with instruments and adjacent surfaces having a range of dimensions.

23. The method of claim 16 wherein the at least one adjacent surface comprises a wellsite equipment surface.

24. The method of claim 16 wherein the at least one adjacent surface is a surface in a wellbore.

25. The method of claim 24 wherein the instrument comprises a one of patch, a plug, an actuator, a tractor, a logging tool, and a sliding sleeve.

26. The method of claim 16 wherein providing comprises providing at least a pair of reversibly expandable structures connected in series along an axial dimension of the at least one instrument.

27. The method of claim 26 wherein performing comprises each of the reversibly expandable structures performing one of exerting thrust to convey the at least one instrument with respect to at least one adjacent surface, creating pressure between the at least one instrument and at least one adjacent surface, and sealing between the at least one instrument and at least one adjacent surface.

* * * * *